US008204261B2

(12) United States Patent
Allamanche et al.

(10) Patent No.: US 8,204,261 B2
(45) Date of Patent: Jun. 19, 2012

(54) DIFFUSE SOUND SHAPING FOR BCC SCHEMES AND THE LIKE

(75) Inventors: Eric Allamanche, Nuremberg (DE); Sascha Disch, Fürth (DE); Christof Faller, Tägerwilen (CH); Juergen Herre, Buckenhof (DE)

(73) Assignees: Fraunhofer-Gesellschaft zur Foerderung der angewandten Forschung e.V., Munich (DE); Agere Systems Inc., Allentown, PA (US)

( * ) Notice: Subject to any disclaimer, the term of this patent is extended or adjusted under 35 U.S.C. 154(b) by 2073 days.

(21) Appl. No.: 11/006,492

(22) Filed: Dec. 7, 2004

(65) Prior Publication Data

US 2006/0085200 A1 Apr. 20, 2006

Related U.S. Application Data

(60) Provisional application No. 60/620,401, filed on Oct. 20, 2004.

(51) Int. Cl.
*H04R 5/02* (2006.01)

(52) U.S. Cl. ..... 381/309; 381/98; 704/E19.005

(58) Field of Classification Search ..... 381/98, 381/309, 106; 704/500, 501, 502, 230, 205, 704/E19.005; 333/14; 455/72; 700/94
See application file for complete search history.

(56) References Cited

U.S. PATENT DOCUMENTS

| | | | | |
|---|---|---|---|---|
| 4,236,039 | A | 11/1980 | Cooper | 381/23 |
| 4,815,132 | A | 3/1989 | Minami | 381/1 |
| 4,972,484 | A * | 11/1990 | Theile et al. | 704/200.1 |
| 5,371,799 | A | 12/1994 | Lowe et al. | 381/25 |
| 5,463,424 | A | 10/1995 | Dressler | 348/485 |
| 5,579,430 | A | 11/1996 | Grill et al. | |
| 5,583,962 | A | 12/1996 | Davis et al. | |
| 5,677,994 | A | 10/1997 | Miyamori et al. | 704/501 |
| 5,682,461 | A | 10/1997 | Silzle et al. | 395/2.14 |
| 5,701,346 | A | 12/1997 | Herre et al. | 381/18 |
| 5,703,999 | A | 12/1997 | Herre et al. | |
| 5,706,309 | A | 1/1998 | Eberlein et al. | 375/260 |
| 5,771,295 | A | 6/1998 | Waller, Jr. | 381/18 |
| 5,812,971 | A | 9/1998 | Herre | 704/230 |
| 5,825,776 | A | 10/1998 | Moon | 370/437 |

(Continued)

FOREIGN PATENT DOCUMENTS

CA 2 326 495 A1 6/2001

(Continued)

OTHER PUBLICATIONS

Theile "Multichannel Natural Music Recording Based on Psychoacoustic Principles", Oct. 30, 2001.*

(Continued)

*Primary Examiner* — Vivian Chin
*Assistant Examiner* — Con P Tran
(74) *Attorney, Agent, or Firm* — Mendelsohn, Drucker & Associates, P.C.; Steve Mendelsohn

(57) ABSTRACT

An input audio signal having an input temporal envelope is converted into an output audio signal having an output temporal envelope. The input temporal envelope of the input audio signal is characterized. The input audio signal is processed to generate a processed audio signal, wherein the processing de-correlates the input audio signal. The processed audio signal is adjusted based on the characterized input temporal envelope to generate the output audio signal, wherein the output temporal envelope substantially matches the input temporal envelope.

31 Claims, 14 Drawing Sheets

U.S. PATENT DOCUMENTS

| | | | | |
|---|---|---|---|---|
| 5,860,060 | A | 1/1999 | Li et al. | 704/500 |
| 5,878,080 | A | 3/1999 | Ten Kate | 375/241 |
| 5,889,843 | A | 3/1999 | Singer et al. | 379/202.01 |
| 5,890,125 | A | 3/1999 | Davis et al. | 704/501 |
| 5,912,976 | A | 6/1999 | Klayman et al. | 381/18 |
| 5,930,733 | A | 7/1999 | Park et al. | |
| 5,946,352 | A | 8/1999 | Rowlands et al. | 375/242 |
| 5,956,674 | A | 9/1999 | Smyth et al. | 704/200.1 |
| 6,016,473 | A | 1/2000 | Dolby | 704/500 |
| 6,021,386 | A | 2/2000 | Davis et al. | 704/229 |
| 6,021,389 | A | 2/2000 | Protopapas | 704/278 |
| 6,108,584 | A | 8/2000 | Edwards | 700/94 |
| 6,111,958 | A | 8/2000 | Maher | 381/17 |
| 6,131,084 | A | 10/2000 | Hardwick | |
| 6,205,430 | B1 | 3/2001 | Hui | 704/500 |
| 6,236,731 | B1 | 5/2001 | Brennan et al. | |
| 6,282,631 | B1 | 8/2001 | Arbel | 712/35 |
| 6,356,870 | B1 | 3/2002 | Hui et al. | 704/500 |
| 6,408,327 | B1 | 6/2002 | McClennon et al. | 709/204 |
| 6,424,939 | B1 * | 7/2002 | Herre et al. | 704/219 |
| 6,434,191 | B1 | 8/2002 | Agrawal et al. | 375/227 |
| 6,539,357 | B1 | 3/2003 | Sinha | 704/270.1 |
| 6,611,212 | B1 | 8/2003 | Craven et al. | |
| 6,614,936 | B1 | 9/2003 | Wu et al. | 382/238 |
| 6,658,117 | B2 | 12/2003 | Hasebe | 381/61 |
| 6,763,115 | B1 | 7/2004 | Kobayashi | 381/309 |
| 6,782,366 | B1 | 8/2004 | Huang et al. | 704/500 |
| 6,823,018 | B1 | 11/2004 | Jafarkhani et al. | 375/245 |
| 6,845,163 | B1 | 1/2005 | Johnston et al. | 381/92 |
| 6,850,496 | B1 | 2/2005 | Knappe et al. | 370/260 |
| 6,885,992 | B2 * | 4/2005 | Mesarovic et al. | 704/500 |
| 6,934,676 | B2 | 8/2005 | Wang et al. | 704/200.1 |
| 6,940,540 | B2 | 9/2005 | Beal et al. | 348/169 |
| 6,973,184 | B1 | 12/2005 | Shaffer et al. | 379/420.01 |
| 6,987,856 | B1 | 1/2006 | Feng et al. | |
| 7,116,787 | B2 | 10/2006 | Faller | 381/17 |
| 7,181,019 | B2 | 2/2007 | Breebaart et al. | |
| 7,343,291 | B2 | 3/2008 | Thumpudi et al. | |
| 7,382,886 | B2 | 6/2008 | Henn et al. | 381/23 |
| 7,516,066 | B2 | 4/2009 | Schuijers et al. | 704/219 |
| 7,644,003 | B2 | 1/2010 | Baumgarte et al. | |
| 7,672,838 | B1 | 3/2010 | Athineos et al. | |
| 7,941,320 | B2 | 5/2011 | Baumgarte et al. | |
| 2001/0031054 | A1 | 10/2001 | Grimani | 381/98 |
| 2001/0031055 | A1 | 10/2001 | Aarts et al. | |
| 2002/0055796 | A1 | 5/2002 | Katayama et al. | 700/94 |
| 2003/0007648 | A1 | 1/2003 | Currell | |
| 2003/0035553 | A1 | 2/2003 | Baumgarte et al. | 381/94.2 |
| 2003/0044034 | A1 * | 3/2003 | Zeng et al. | 381/317 |
| 2003/0081115 | A1 | 5/2003 | Curry et al. | 348/14.12 |
| 2003/0161479 | A1 | 8/2003 | Yang et al. | 381/22 |
| 2003/0187663 | A1 | 10/2003 | Truman et al. | 704/500 |
| 2003/0219130 | A1 | 11/2003 | Baumgarte et al. | 381/17 |
| 2003/0236583 | A1 | 12/2003 | Baumgarte et al. | 700/94 |
| 2004/0091118 | A1 | 5/2004 | Griesinger | 381/20 |
| 2005/0053242 | A1 | 3/2005 | Henn et al. | 381/22 |
| 2005/0069143 | A1 | 3/2005 | Budnikov et al. | 381/63 |
| 2005/0157883 | A1 | 7/2005 | Herre et al. | 381/17 |
| 2005/0226426 | A1 | 10/2005 | Oomen et al. | 381/23 |
| 2006/0206323 | A1 | 9/2006 | Breebaart | 704/230 |
| 2007/0094012 | A1 | 4/2007 | Pang et al. | |

FOREIGN PATENT DOCUMENTS

| | | | |
|---|---|---|---|
| CN | 1295778 | | 5/2001 |
| EP | 1 107 232 | A2 | 6/2001 |
| EP | 1 376 538 | A1 | 1/2004 |
| EP | 1 479 071 | B1 | 1/2006 |
| JP | 07123008 | | 5/1995 |
| JP | H10-051313 | | 2/1998 |
| JP | 2000-151413 | A | 5/2000 |
| JP | 2001-339311 | A | 12/2001 |
| JP | 2003-044096 | A | 2/2003 |
| JP | 2004193877 | A | 7/2004 |
| JP | 2004-535145 | A | 11/2004 |
| TW | 347623 | | 12/1998 |
| TW | 360859 | | 6/1999 |
| TW | 444511 | | 7/2001 |
| TW | 510144 | | 11/2002 |
| TW | 517223 | | 1/2003 |
| TW | 521261 | | 2/2003 |
| WO | WO 92/12607 | A1 | 7/1992 |
| WO | WO 99/52326 | A1 | 10/1999 |
| WO | WO 02/29808 | A2 | 4/2002 |
| WO | WO 03/007656 | A1 | 1/2003 |
| WO | WO 03/090207 | A1 | 10/2003 |
| WO | WO 03/090208 | A1 | 10/2003 |
| WO | WO 03/094369 | A2 | 11/2003 |
| WO | WO 2004/008806 | A1 | 1/2004 |
| WO | WO 2004/036548 | A1 | 4/2004 |
| WO | WO 2004/049309 | A1 | 6/2004 |
| WO | WO 2004/072956 | A1 | 8/2004 |
| WO | WO 2004/077884 | A1 | 9/2004 |
| WO | WO 2004/086817 | A2 | 10/2004 |
| WO | WO 2005/069274 | A1 | 7/2005 |

OTHER PUBLICATIONS

"Parametric Coding of Spatial Audio—Thesis No. 3062," by Christof Faller, These Presentee a La Faculte Informatique et Communications Institit De Systemes De Communication Section Des Systems De Communication École Polytechnique Fédérale De Lausanne Pour L'Obtention Du Grade De Docteur Es Sciences, Jul. 2004, XP002343263, Lausanne, Section 5.3, pp. 71-84.

"Surround Sound Past, Present, and Future" by Joseph Hull; Dolby Laboratories Inc.; 1999; 8 pages.

"MP3 Surround: Efficient and Compatible Coding of Multi-Channel Audio", by Juergen Herre et al., Audio Engineering Society 116$^{th}$ Convention Paper, May 8-11, 2004, Berlin, Germany, pp. 1-14.

"*Final text for DIS 11172-1 (rev. 2): Information Technology—Coding of Moving Pictures and Associated Audio for Digital Storage Media—Part 1,*" ISO/IEC JTC 1/SC 29 N 147, Apr. 20, 1992 Section 3: Audio, XP-002083108, 2 pages.

"MPEG Audio Layer II: A Genetic Coding Standard for Two and Multichannel Sound for DVB, DAB and Computer Multimedia," by G. Stoll, International Broadcasting Convention, Sep. 14-18, 1995, Germany, XP006528918, pp. 136-144.

"Binaural Cue Coding Applied to Stereo and Multi-Channel Audio Compression," by Christof Faller et al., Audio Engineering Society 112$^{th}$ Covention, Munich, Germany, vol. 112, No. 5574, May 10, 2002, pp. 1-9.

"Advances in Parametric Coding for High-Quality Audio," by Erik Schuijers et al., Audio Engineering Society Convention Paper 5852, 114$^{th}$ Convention, Amsterdam, The Netherlands, Mar. 22-25, 2003, pp. 1-11.

"Advances in Parametric Coding for High-Quality Audio," by E.G.P. Schuijers et al., Proc. 1$^{st}$ IEEE Benelux Workshop on Model Based Processing and Coding of Audio (MPCA-2002), Leuven, Belgium, Nov. 15, 2002, pp. 73-79, XP001156065.

"Improving Audio Codecs by Noise Substitution," by Donald Schulz, Journal of the Audio Engineering Society, vol. 44, No. 7/8, Jul./Aug. 1996, pp. 593-598, XP000733647.

"The Reference Model Architecture for MPEG Spatial Audio Coding," by Juergen Herre et al., Audio Engineering Society Convention Paper 6447, 118$^{th}$ Convention, May 28-31, 2005, Barcelona, Spain, pp. 1-13, XP009059973.

"From Joint Stereo to Spatial Audio Coding—Recent Progress and Standardization," by Jurgen Herre, Proc. of the 7$^{th}$ Int. Conference on Digital Audio Effects (DAFx'04), Oct. 5-8, 2004, Naples, Italy, XP002367849.

"Parametric Coding of Spatial Audio," by Christof Faller, Proc. of the 7$^{th}$ Int. Conference on Digital Audio Effects (DAFx'04), Oct. 5-8, 2004, Naples, Itlay, XP002367850.

"Binaural Cue Coding—Part I: Psychoacoustic Fundamentals and Design Principles", by Frank Baumgrate et al., IEEE Transactions on Speech and Audio Processing, vol. II, No. 6, Nov. 2003, pp. 509-519.

"Binaural Cue Coding—Part II: Schemes and Applications", by Christof Faller et al., IEEE Transactions on Speech and Audio Processing, vol. II, No. 6, Nov. 2003, pp. 520-531.

"Low Complexity Parametric Stereo Coding", by Erik Schuijers et al., Audio Engineering Society 116$^{th}$ Convention Paper 6073, May 8-11, 2004, Berlin, Germany, pp. 1-11.

"Coding of Spatial Audio Compatible With Different Playback Formats", by Christof Faller, Audio Engineering Society 117th Convention, San Francisco, CA, Oct. 28-31, 2004, pp. 1-12.
Office Action for Japanese Patent Application No. 2007-537133 dated Feb. 16, 2010.
Christof Faller, "Parametric Coding of Spatial Audio, These No. 3062," Presentee A La Faculte Informatique et Communications, Institut de Systemes de Communication, Ecole Polytechnique Federale de Lausanne, Lausanne, EPFL 2004.
van der Waal, R.G. et al., "Subband Coding of Stereographic Digital Audio Signals," Proc. of ICASSP '91, IEEE Computer Society, May 1991, pp. 3601-3604.
"A Speech Corpus for Multitalker Communications Research", by Robert S. Bolia, et al., J. Acoust. Soc., Am., vol. 107, No. 2, Feb. 2000, pp. 1065-1066.
"Synthesized Stereo Combined with Acoustic Echo Cancellation for Desktop Conferencing", by Jacob Benesty et al., Bell Labs Technical Journal, Jul.-Sep. 1998, pp. 148-158.
"The Role of Perceived Spatial Separation in the Unmasking of Speech", by Richard Freyman et al., J. Acoust. Soc., Am., vol. 106, No. 6, Dec. 1999, pp. 3578-3588.
"Text of ISO/IEC 14496-3:2002/PDAM 2 (Parametric coding for High Quality Audio)", by International Organisation for Standisation ISO/IEC JTC1/SC29/WG11 Coding of Moving Pictures and Audio, MPEG2002 N5381 Awaji Island, Dec. 2002, pp. 1-69.
"Colorless Artificial Reverberation", by M.R. Schroeder et al., IRE Transactions on Audio, pp. 209-214, (Originally Published by: J. Audio Engrg. Soc., vol. 9, pp. 192-197, Jul. 1961).
"Efficient Representation of Spatial Audio Using Perceptual Parametrization",, by Christof Faller etl al., IEEE Workshop on Applications of Signal Processing to Audio and Acoustics 2001, Oct. 21-24, 2001, New Paltz, New York, pp. W2001-01 to W2001-4.
"3D Audio and Acoustic Environment Modeling" by William G. Gardner, HeadWize Technical Paper, Jan. 2001, pp. 1-11.
"Responding to One of Two Simultaneous Message", by Walter Spieth et al., The Journal of the Acoustical Society of America, vol. 26, No. 3, May 1954, pp. 391-396.
"Information Technology—Coding of Audio-Visual Objects—Part 1: MPEG Surround (ISO/IEC JTC 1/SC 29/WG11 N7387)," Jul. 2005, International Organization for Standardization, Poznan, Poland, XP00237055, p. 46, lines 1,2.
"Spatial Audio Coding: Next-Generation Efficient and Compatible Coding of Multi-Channel Audio," by J. Herre et al., Audio Engineering Society Convention Paper Presented at the 117th Convention, Oct. 28-31, 2004, San Francisco, CA, XP-002343375, pp. 1-13.
Non-Final Office Action received in U.S. Appl. No. 12/550,519, filed Aug. 31, 2009 dated Dec. 21, 2010.
"Multichannel Natural Music Recording Based on Psychoacoustic Principles", by Gunther Theile, Extended version of the paper presented at the AES 19th International Conference, May 2001, Oct. 2001, pp. 1-45.
Advisory Action: Mailed Oct. 20, 2011 for the corresponding U.S. Appl. No. 12/550,519.
Final Office Action; Mailed Aug. 5, 2011 for the corresponding U.S. Appl. No. 12/550,519.
"Advances in Parametric Audio Coding" by Heiko Purnhagen, Proc. 1999 IEEE Workshop on Applications of Signal Processing to Audio and Acoustics, New Paltz, New York, Oct. 17-20, 1999, pp. W99-1-W99-4.
Notice of Allowance; Mailed Apr. 26, 2012 for corresponding U.S. Appl. No. 12/550,519.

* cited by examiner

DIFFUSE SOUND SHAPING FOR BCC SCHEMES AND THE LIKE

CROSS-REFERENCE TO RELATED APPLICATIONS

This application claims the benefit of the filing date of U.S. provisional application No. 60/620,401, filed on Oct. 20, 2004, the teachings of which are incorporated herein by reference.

In addition, the subject matter of this application is related to the subject matter of the following U.S. applications, the teachings of all of which are incorporated herein by reference:

U.S. application Ser. No. 09/848,877, filed on May 4, 2001;

U.S. application Ser. No. 10/045,458, filed on Nov. 7, 2001, which itself claimed the benefit of the filing date of U.S. provisional application No. 60/311,565, filed on Aug. 10, 2001;

U.S. application Ser. No. 10/155,437, filed on May 24, 2002;

U.S. application Ser. No. 10/246,570, filed on Sep. 18, 2002;

U.S. application Ser. No. 10/815,591, filed on Apr. 1, 2004;

U.S. application Ser. No. 10/936,464, filed on Sep. 8, 2004;

U.S. application Ser. No. 10/762,100, filed on Jan. 20, 2004 (Faller 13-1); and

U.S. application Ser. No. 11/006,482, filed on the same date as this application.

The subject matter of this application is also related to subject matter described in the following papers, the teachings of all of which are incorporated herein by reference:

F. Baumgarte and C. Faller, "Binaural Cue Coding—Part I: Psychoacoustic fundamentals and design principles," *IEEE Trans. on Speech and Audio Proc.*, vol. 11, no. 6, November 2003;

C. Faller and F. Baumgarte, "Binaural Cue Coding—Part II: Schemes and applications," *IEEE Trans. on Speech and Audio Proc.*, vol. 11, no. 6, November 2003; and C. Faller, "Coding of spatial audio compatible with different playback formats," *Preprint* 117$^{th}$ *Conv. Aud. Eng Soc.*, October 2004.

BACKGROUND OF THE INVENTION

1. Field of the Invention

The present invention relates to the encoding of audio signals and the subsequent synthesis of auditory scenes from the encoded audio data.

2. Description of the Related Art

When a person hears an audio signal (i.e., sounds) generated by a particular audio source, the audio signal will typically arrive at the person's left and right ears at two different times and with two different audio (e.g., decibel) levels, where those different times and levels are functions of the differences in the paths through which the audio signal travels to reach the left and right ears, respectively. The person's brain interprets these differences in time and level to give the person the perception that the received audio signal is being generated by an audio source located at a particular position (e.g., direction and distance) relative to the person. An auditory scene is the net effect of a person simultaneously hearing audio signals generated by one or more different audio sources located at one or more different positions relative to the person.

The existence of this processing by the brain can be used to synthesize auditory scenes, where audio signals from one or more different audio sources are purposefully modified to generate left and right audio signals that give the perception that the different audio sources are located at different positions relative to the listener.

FIG. 1 shows a high-level block diagram of conventional binaural signal synthesizer 100, which converts a single audio source signal (e.g., a mono signal) into the left and right audio signals of a binaural signal, where a binaural signal is defined to be the two signals received at the eardrums of a listener. In addition to the audio source signal, synthesizer 100 receives a set of spatial cues corresponding to the desired position of the audio source relative to the listener. In typical implementations, the set of spatial cues comprises an inter-channel level difference (ICLD) value (which identifies the difference in audio level between the left and right audio signals as received at the left and right ears, respectively) and an inter-channel time difference (ICTD) value (which identifies the difference in time of arrival between the left and right audio signals as received at the left and right ears, respectively). In addition or as an alternative, some synthesis techniques involve the modeling of a direction-dependent transfer function for sound from the signal source to the eardrums, also referred to as the head-related transfer function (HRTF). See, e.g., J. Blauert, *The Psychophysics of Human Sound Localization*, MIT Press, 1983, the teachings of which are incorporated herein by reference.

Using binaural signal synthesizer 100 of FIG. 1, the mono audio signal generated by a single sound source can be processed such that, when listened to over headphones, the sound source is spatially placed by applying an appropriate set of spatial cues (e.g., ICLD, ICTD, and/or HRTF) to generate the audio signal for each ear. See, e.g., D. R. Begault, 3-*D Sound for Virtual Reality and Multimedia*, Academic Press, Cambridge, Mass., 1994.

Binaural signal synthesizer 100 of FIG. 1 generates the simplest type of auditory scenes: those having a single audio source positioned relative to the listener. More complex auditory scenes comprising two or more audio sources located at different positions relative to the listener can be generated using an auditory scene synthesizer that is essentially implemented using multiple instances of binaural signal synthesizer, where each binaural signal synthesizer instance generates the binaural signal corresponding to a different audio source. Since each different audio source has a different location relative to the listener, a different set of spatial cues is used to generate the binaural audio signal for each different audio source.

SUMMARY OF THE INVENTION

According to one embodiment, the present invention is a method and apparatus for converting an input audio signal having an input temporal envelope into an output audio signal having an output temporal envelope. The input temporal envelope of the input audio signal is characterized. The input audio signal is processed to generate a processed audio signal, wherein the processing de-correlates the input audio signal. The processed audio signal is adjusted based on the characterized input temporal envelope to generate the output audio signal, wherein the output temporal envelope substantially matches the input temporal envelope.

According to another embodiment, the present invention is a method and apparatus for encoding C input audio channels to generate E transmitted audio channel(s). One or more cue codes are generated for two or more of the C input channels. The C input channels are downmixed to generate the E transmitted channel(s), where $C>E\geqq 1$. One or more of the C input channels and the E transmitted channel(s) are analyzed to generate a flag indicating whether or not a decoder of the E transmitted channel(s) should perform envelope shaping during decoding of the E transmitted channel(s).

According to another embodiment, the present invention is an encoded audio bitstream generated by the method of the previous paragraph.

According to another embodiment, the present invention is an encoded audio bitstream comprising E transmitted channel(s), one or more cue codes, and a flag. The one or more cue codes are generated by generating one or more cue codes for two or more of the C input channels. The E transmitted channel(s) are generated by downmixing the C input channels, where $C>E\geqq 1$. The flag is generated by analyzing one or more of the C input channels and the E transmitted channel(s), wherein the flag indicates whether or not a decoder of the E transmitted channel(s) should perform envelope shaping during decoding of the E transmitted channel(s).

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 1:
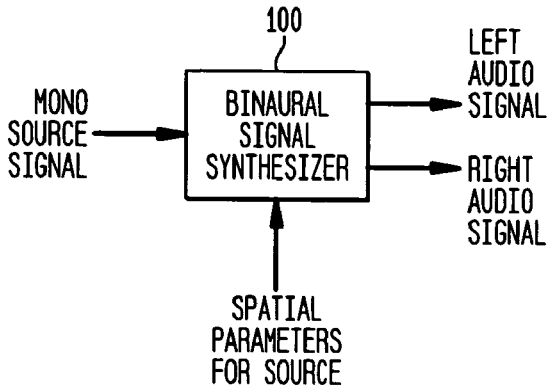
FIG. 1 (PRIOR ART)
FIG. 1 shows a high-level block diagram of conventional binaural signal synthesizer.

In binaural cue coding (BCC), an encoder encodes C input audio channels to generate E transmitted audio channels, where $C>E\geqq 1$. In particular, two or more of the C input channels are provided in a frequency domain, and one or more cue codes are generated for each of one or more different frequency bands in the two or more input channels in the frequency domain. In addition, the C input channels are downmixed to generate the E transmitted channels. In some downmixing implementations, at least one of the E transmitted channels is based on two or more of the C input channels, and at least one of the E transmitted channels is based on only a single one of the C input channels.

In one embodiment, a BCC coder has two or more filter banks, a code estimator, and a downmixer. The two or more filter banks convert two or more of the C input channels from a time domain into a frequency domain. The code estimator generates one or more cue codes for each of one or more different frequency bands in the two or more converted input channels. The downmixer downmixes the C input channels to generate the E transmitted channels, where $C>E\geqq 1$.

In BCC decoding, E transmitted audio channels are decoded to generate C playback audio channels. In particular, for each of one or more different frequency bands, one or more of the E transmitted channels are upmixed in a frequency domain to generate two or more of the C playback channels in the frequency domain, where $C>E\geqq 1$. One or more cue codes are applied to each of the one or more different frequency bands in the two or more playback channels in the frequency domain to generate two or more modified channels, and the two or more modified channels are converted from the frequency domain into a time domain. In some upmixing implementations, at least one of the C playback channels is based on at least one of the E transmitted channels and at least one cue code, and at least one of the C playback channels is based on only a single one of the E transmitted channels and independent of any cue codes.

In one embodiment, a BCC decoder has an upmixer, a synthesizer, and one or more inverse filter banks. For each of one or more different frequency bands, the upmixer upmixes one or more of the E transmitted channels in a frequency domain to generate two or more of the C playback channels in the frequency domain, where $C>E\geqq 1$. The synthesizer applies one or more cue codes to each of the one or more different frequency bands in the two or more playback channels in the frequency domain to generate two or more modified channels. The one or more inverse filter banks convert the two or more modified channels from the frequency domain into a time domain.

Depending on the particular implementation, a given playback channel may be based on a single transmitted channel, rather than a combination of two or more transmitted channels. For example, when there is only one transmitted channel, each of the C playback channels is based on that one transmitted channel. In these situations, upmixing corresponds to copying of the corresponding transmitted channel.

As such, for applications in which there is only one transmitted channel, the upmixer may be implemented using a replicator that copies the transmitted channel for each playback channel.

BCC encoders and/or decoders may be incorporated into a number of systems or applications including, for example, digital video recorders/players, digital audio recorders/players, computers, satellite transmitters/receivers, cable transmitters/receivers, terrestrial broadcast transmitters/receivers, home entertainment systems, and movie theater systems.

Generic BCC Processing

Figure 2:
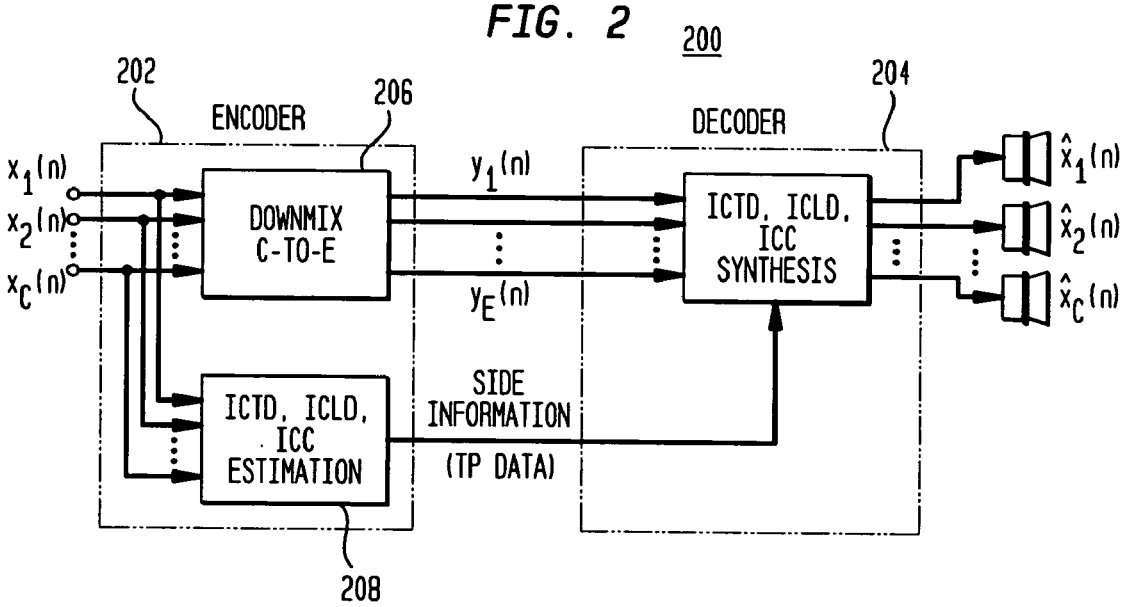
FIG. 2 is a block diagram of a generic binaural cue coding (BCC) audio processing system.

FIG. 2 is a block diagram of a generic binaural cue coding (BCC) audio processing system 200 comprising an encoder 202 and a decoder 204. Encoder 202 includes downmixer 206 and BCC estimator 208.

Downmixer 206 converts C input audio channels $x_i(n)$ into E transmitted audio channels $y_i(n)$, where $C>E\geqq 1$. In this specification, signals expressed using the variable n are time-domain signals, while signals expressed using the variable k are frequency-domain signals. Depending on the particular implementation, downmixing can be implemented in either the time domain or the frequency domain. BCC estimator 208 generates BCC codes from the C input audio channels and transmits those BCC codes as either in-band or out-of-band side information relative to the E transmitted audio channels. Typical BCC codes include one or more of inter-channel time difference (ICTD), inter-channel level difference (ICLD), and inter-channel correlation (ICC) data estimated between certain pairs of input channels as a function of frequency and time. The particular implementation will dictate between which particular pairs of input channels, BCC codes are estimated.

ICC data corresponds to the coherence of a binaural signal, which is related to the perceived width of the audio source. The wider the audio source, the lower the coherence between the left and right channels of the resulting binaural signal. For example, the coherence of the binaural signal corresponding to an orchestra spread out over an auditorium stage is typically lower than the coherence of the binaural signal corresponding to a single violin playing solo. In general, an audio signal with lower coherence is usually perceived as more spread out in auditory space. As such, ICC data is typically related to the apparent source width and degree of listener envelopment. See, e.g., J. Blauert, *The Psychophysics of Human Sound Localization*, MIT Press, 1983.

Depending on the particular application, the E transmitted audio channels and corresponding BCC codes may be transmitted directly to decoder 204 or stored in some suitable type of storage device for subsequent access by decoder 204. Depending on the situation, the term "transmitting" may refer to either direct transmission to a decoder or storage for subsequent provision to a decoder. In either case, decoder 204 receives the transmitted audio channels and side information and performs upmixing and BCC synthesis using the BCC codes to convert the E transmitted audio channels into more than E (typically, but not necessarily, C) playback audio channels $\hat{x}_i(n)$ for audio playback. Depending on the particular implementation, upmixing can be performed in either the time domain or the frequency domain.

In addition to the BCC processing shown in FIG. 2, a generic BCC audio processing system may include additional encoding and decoding stages to further compress the audio signals at the encoder and then decompress the audio signals at the decoder, respectively. These audio codecs may be based on conventional audio compression/decompression techniques such as those based on pulse code modulation (PCM), differential PCM (DPCM), or adaptive DPCM (ADPCM).

When downmixer 206 generates a single sum signal (i.e., E=1), BCC coding is able to represent multi-channel audio signals at a bitrate only slightly higher than what is required to represent a mono audio signal. This is so, because the estimated ICTD, ICLD, and ICC data between a channel pair contain about two orders of magnitude less information than an audio waveform.

Not only the low bitrate of BCC coding, but also its backwards compatibility aspect is of interest. A single transmitted sum signal corresponds to a mono downmix of the original stereo or multi-channel signal. For receivers that do not support stereo or multi-channel sound reproduction, listening to the transmitted sum signal is a valid method of presenting the audio material on low-profile mono reproduction equipment. BCC coding can therefore also be used to enhance existing services involving the delivery of mono audio material towards multi-channel audio. For example, existing mono audio radio broadcasting systems can be enhanced for stereo or multi-channel playback if the BCC side information can be embedded into the existing transmission channel. Analogous capabilities exist when downmixing multi-channel audio to two sum signals that correspond to stereo audio.

BCC processes audio signals with a certain time and frequency resolution. The frequency resolution used is largely motivated by the frequency resolution of the human auditory system. Psychoacoustics suggests that spatial perception is most likely based on a critical band representation of the acoustic input signal. This frequency resolution is considered by using an invertible filterbank (e.g., based on a fast Fourier transform (FFT) or a quadrature mirror filter (QMF)) with subbands with bandwidths equal or proportional to the critical bandwidth of the human auditory system.

Generic Downmixing

In preferred implementations, the transmitted sum signal(s) contain all signal components of the input audio signal. The goal is that each signal component is fully maintained. Simply summation of the audio input channels often results in amplification or attenuation of signal components. In other words, the power of the signal components in a "simple" sum is often larger or smaller than the sum of the power of the corresponding signal component of each channel. A downmixing technique can be used that equalizes the sum signal such that the power of signal components in the sum signal is approximately the same as the corresponding power in all input channels.

Figure 3:
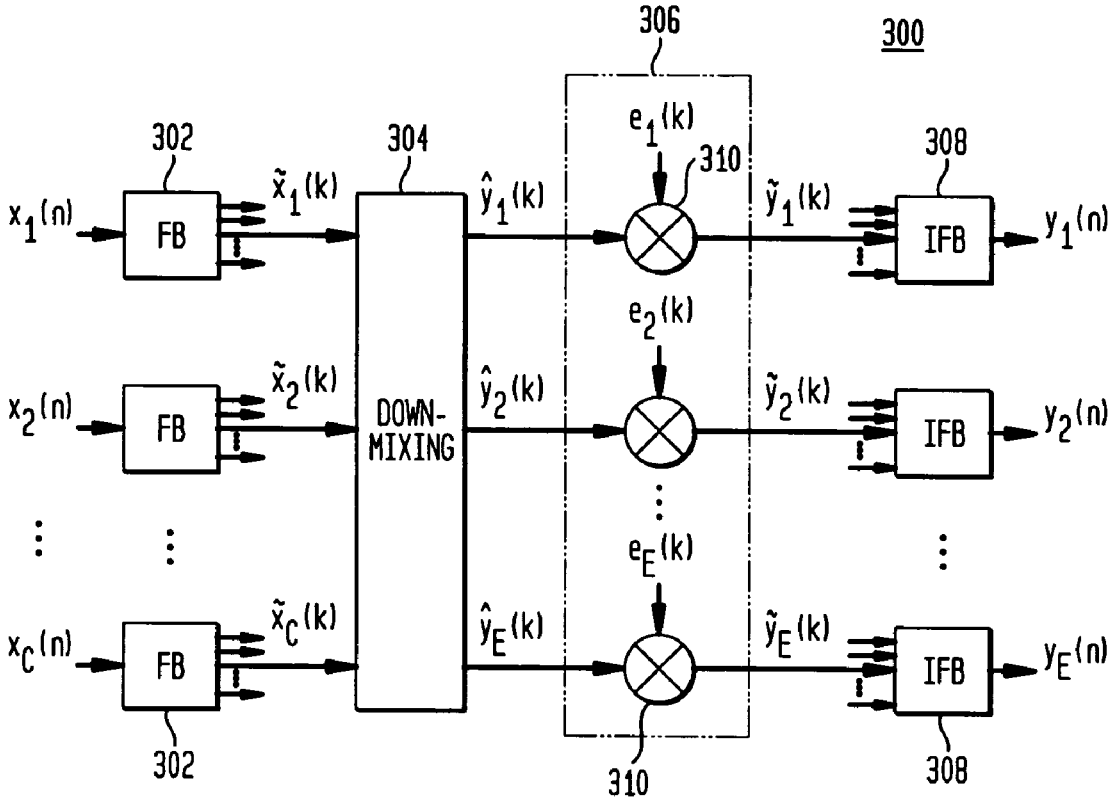
FIG. 3 shows a block diagram of a downmixer that can be used for the downmixer of FIG. 2.

FIG. 3 shows a block diagram of a downmixer 300 that can be used for downmixer 206 of FIG. 2 according to certain implementations of BCC system 200. Downmixer 300 has a filter bank (FB) 302 for each input channel $x_i(n)$, a downmixing block 304, an optional scaling/delay block 306, and an inverse FB (IFB) 308 for each encoded channel $y_i(n)$.

Each filter bank 302 converts each frame (e.g., 20 msec) of a corresponding digital input channel $x_i(n)$ in the time domain into a set of input coefficients $\tilde{x}_i(k)$ in the frequency domain. Downmixing block 304 downmixes each sub-band of C corresponding input coefficients into a corresponding sub-band of E downmixed frequency-domain coefficients. Equation (1) represents the downmixing of the kth sub-band of input coefficients $(\tilde{x}_1(k), \tilde{x}_2(k), \ldots, \tilde{x}_C(k))$ to generate the kth sub-band of downmixed coefficients $(\hat{y}_1(k), \hat{y}_2(k), \ldots, \hat{y}_E(k))$ as follows:

$$\begin{bmatrix} \hat{y}_1(k) \\ \hat{y}_2(k) \\ \vdots \\ \hat{y}_E(k) \end{bmatrix} = D_{CE} \begin{bmatrix} \tilde{x}_1(k) \\ \tilde{x}_2(k) \\ \vdots \\ \tilde{x}_C(k) \end{bmatrix}, \tag{1}$$

where $D_{CE}$ is a real-valued C-by-E downmixing matrix.

Optional scaling/delay block 306 comprises a set of multipliers 310, each of which multiplies a corresponding downmixed coefficient $\hat{y}_i(k)$ by a scaling factor $e_i(k)$ to generate a corresponding scaled coefficient $\tilde{y}_i(k)$. The motivation for the scaling operation is equivalent to equalization generalized for downmixing with arbitrary weighting factors for each channel. If the input channels are independent, then the power $p_{\tilde{y}_i(k)}$ of the downmixed signal in each sub-band is given by Equation (2) as follows:

$$\begin{bmatrix} p_{\tilde{y}_1(k)} \\ p_{\tilde{y}_2(k)} \\ \vdots \\ p_{\tilde{y}_E(k)} \end{bmatrix} = \overline{D}_{CE} \begin{bmatrix} p_{\tilde{x}_1(k)} \\ p_{\tilde{x}_2(k)} \\ \vdots \\ p_{\tilde{x}_C(k)} \end{bmatrix}, \tag{2}$$

where $\overline{D}_{CE}$ is derived by squaring each matrix element in the C-by-E downmixing matrix $D_{CE}$ and $p_{\tilde{x}_i(k)}$ is the power of sub-band k of input channel i.

If the sub-bands are not independent, then the power values $p_{\tilde{y}_i(k)}$ of the downmixed signal will be larger or smaller than that computed using Equation (2), due to signal amplifications or cancellations when signal components are in-phase or out-of-phase, respectively. To prevent this, the downmixing operation of Equation (1) is applied in sub-bands followed by the scaling operation of multipliers 310. The scaling factors $e_i(k)$ ($1 \leqq i \leqq E$) can be derived using Equation (3) as follows:

$$e_i(k) = \sqrt{\frac{p_{\tilde{y}_i(k)}}{p_{\hat{y}_i(k)}}}, \tag{3}$$

where $p_{\tilde{y}_k(k)}$ is the sub-band power as computed by Equation (2), and $p_{\hat{y}_i(k)}$ is power of the corresponding downmixed sub-band signal $\hat{y}_i(k)$.

In addition to or instead of providing optional scaling, scaling/delay block 306 may optionally apply delays to the signals.

Each inverse filter bank 308 converts a set of corresponding scaled coefficients $\tilde{y}_i(k)$ in the frequency domain into a frame of a corresponding digital, transmitted channel $y_i(n)$.

Although FIG. 3 shows all C of the input channels being converted into the frequency domain for subsequent downmixing, in alternative implementations, one or more (but less than C−1) of the C input channels might bypass some or all of the processing shown in FIG. 3 and be transmitted as an equivalent number of unmodified audio channels. Depending on the particular implementation, these unmodified audio channels might or might not be used by BCC estimator 208 of FIG. 2 in generating the transmitted BCC codes.

In an implementation of downmixer 300 that generates a single sum signal y(n), E=1 and the signals $\tilde{x}_c(k)$ of each subband of each input channel c are added and then multiplied with a factor e(k), according to Equation (4) as follows:

$$\tilde{y}(k) = e(k) \sum_{c=1}^{C} \tilde{x}_c(k). \tag{4}$$

the factor e(k) is given by Equation (5) as follows:

$$e(k) = \sqrt{\frac{\sum_{c=1}^{C} p_{\tilde{x}_c}(k)}{p_{\tilde{x}}(k)}}, \tag{5}$$

where $p_{\tilde{x}_c}(k)$ is a short-time estimate of the power of $\tilde{x}_c(k)$ at time index k, and $p_{\tilde{x}}(k)$ is a short-time estimate of the power of $$\sum_{c=1}^{C} \tilde{x}_c(k).$$

The equalized subbands are transformed back to the time domain resulting in the sum signal y(n) that is transmitted to the BCC decoder.

Generic BCC Synthesis

Figure 4:
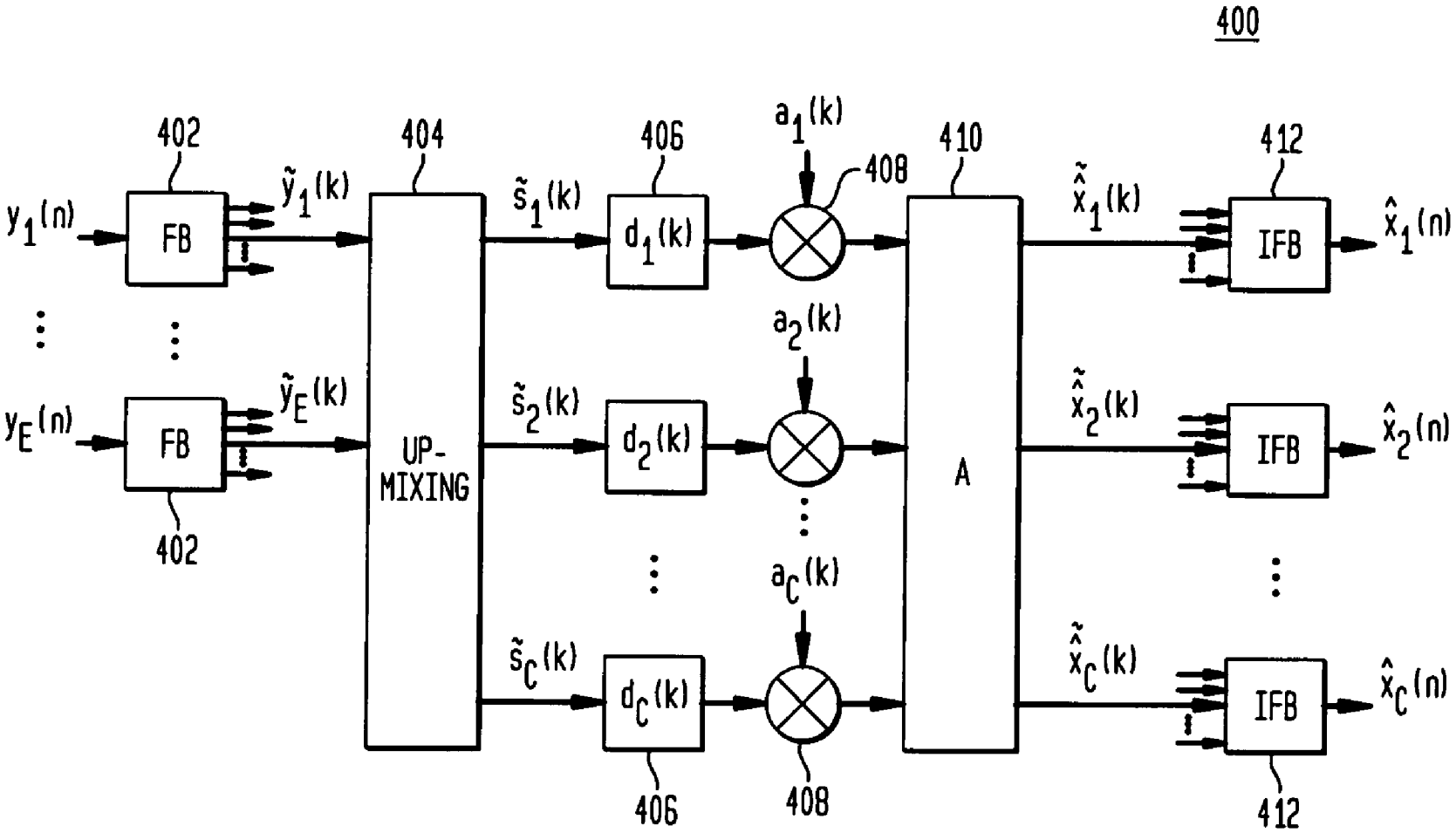
FIG. 4 shows a block diagram of a BCC synthesizer that can be used for the decoder of FIG. 2.

FIG. 4 shows a block diagram of a BCC synthesizer 400 that can be used for decoder 204 of FIG. 2 according to certain implementations of BCC system 200. BCC synthesizer 400 has a filter bank 402 for each transmitted channel $y_i(n)$, an upmixing block 404, delays 406, multipliers 408, correlation block 410, and an inverse filter bank 412 for each playback channel $\hat{x}_i(n)$.

Each filter bank 402 converts each frame of a corresponding digital, transmitted channel $y_i(n)$ in the time domain into a set of input coefficients $\tilde{y}_i(k)$ in the frequency domain. Upmixing block 404 upmixes each sub-band of E corresponding transmitted-channel coefficients into a corresponding sub-band of C upmixed frequency-domain coefficients. Equation (4) represents the upmixing of the kth sub-band of transmitted-channel coefficients ($\tilde{y}_1(k), \tilde{y}_2(k), \ldots, \tilde{y}_E(k)$) to generate the kth sub-band of upmixed coefficients ($\tilde{s}_1(k), \tilde{s}_2(k), \ldots, \tilde{s}_C(k)$) as follows:

$$\begin{bmatrix} \tilde{s}_1(k) \\ \tilde{s}_2(k) \\ \vdots \\ \tilde{s}_C(k) \end{bmatrix} = U_{EC} \begin{bmatrix} \tilde{y}_1(k) \\ \tilde{y}_2(k) \\ \vdots \\ \tilde{y}_E(k) \end{bmatrix}, \tag{6}$$

where $U_{EC}$ is a real-valued E-by-C upmixing matrix. Performing upmixing in the frequency-domain enables upmixing to be applied individually in each different sub-band.

Each delay 406 applies a delay value $d_i(k)$ based on a corresponding BCC code for ICTD data to ensure that the desired ICTD values appear between certain pairs of playback channels. Each multiplier 408 applies a scaling factor $a_i(k)$ based on a corresponding BCC code for ICLD data to ensure that the desired ICLD values appear between certain pairs of playback channels. Correlation block 410 performs a decorrelation operation A based on corresponding BCC codes for ICC data to ensure that the desired ICC values appear between certain pairs of playback channels. Further description of the operations of correlation block 410 can be found in U.S. patent application Ser. No. 10/155,437, filed on May 24, 2002 as Baumgarte 2-10.

The synthesis of ICLD values may be less troublesome than the synthesis of ICTD and ICC values, since ICLD synthesis involves merely scaling of sub-band signals. Since ICLD cues are the most commonly used directional cues, it is usually more important that the ICLD values approximate those of the original audio signal. As such, ICLD data might be estimated between all channel pairs. The scaling factors $a_i(k)$ ($1 \leqq i \leqq C$) for each sub-band are preferably chosen such that the sub-band power of each playback channel approximates the corresponding power of the original input audio channel.

One goal may be to apply relatively few signal modifications for synthesizing ICTD and ICC values. As such, the BCC data might not include ICTD and ICC values for all channel pairs. In that case, BCC synthesizer 400 would synthesize ICTD and ICC values only between certain channel pairs.

Each inverse filter bank 412 converts a set of corresponding synthesized coefficients $\tilde{\hat{x}}_i(k)$ in the frequency domain into a frame of a corresponding digital, playback channel $\hat{x}_i(n)$.

Although FIG. 4 shows all E of the transmitted channels being converted into the frequency domain for subsequent upmixing and BCC processing, in alternative implementations, one or more (but not all) of the E transmitted channels might bypass some or all of the processing shown in FIG. 4. For example, one or more of the transmitted channels may be unmodified channels that are not subjected to any upmixing. In addition to being one or more of the C playback channels, these unmodified channels, in turn, might be, but do not have to be, used as reference channels to which BCC processing is applied to synthesize one or more of the other playback channels. In either case, such unmodified channels may be subjected to delays to compensate for the processing time involved in the upmixing and/or BCC processing used to generate the rest of the playback channels.

Note that, although FIG. 4 shows C playback channels being synthesized from E transmitted channels, where C was also the number of original input channels, BCC synthesis is not limited to that number of playback channels. In general, the number of playback channels can be any number of channels, including numbers greater than or less than C and possibly even situations where the number of playback channels is equal to or less than the number of transmitted channels.

"Perceptually Relevant Differences" Between Audio Channels

Assuming a single sum signal, BCC synthesizes a stereo or multi-channel audio signal such that ICTD, ICLD, and ICC approximate the corresponding cues of the original audio signal. In the following, the role of ICTD, ICLD, and ICC in relation to auditory spatial image attributes is discussed.

Knowledge about spatial hearing implies that for one auditory event, ICTD and ICLD are related to perceived direction. When considering binaural room impulse responses (BRIRs) of one source, there is a relationship between width of the auditory event and listener envelopment and ICC data estimated for the early and late parts of the BRIRs. However, the relationship between ICC and these properties for general signals (and not just the BRIRs) is not straightforward.

Stereo and multi-channel audio signals usually contain a complex mix of concurrently active source signals superimposed by reflected signal components resulting from recording in enclosed spaces or added by the recording engineer for artificially creating a spatial impression. Different source signals and their reflections occupy different regions in the time-frequency plane. This is reflected by ICTD, ICLD, and ICC, which vary as a function of time and frequency. In this case, the relation between instantaneous ICTD, ICLD, and ICC and auditory event directions and spatial impression is not obvious. The strategy of certain embodiments of BCC is to blindly synthesize these cues such that they approximate the corresponding cues of the original audio signal.

Filterbanks with subbands of bandwidths equal to two times the equivalent rectangular bandwidth (ERB) are used. Informal listening reveals that the audio quality of BCC does not notably improve when choosing higher frequency resolution. A lower frequency resolution may be desired, since it results in less ICTD, ICLD, and ICC values that need to be transmitted to the decoder and thus in a lower bitrate.

Regarding time resolution, ICTD, ICLD, and ICC are typically considered at regular time intervals. High performance is obtained when ICTD, ICLD, and ICC are considered about every 4 to 16 ms. Note that, unless the cues are considered at very short time intervals, the precedence effect is not directly considered. Assuming a classical lead-lag pair of sound stimuli, if the lead and lag fall into a time interval where only one set of cues is synthesized, then localization dominance of the lead is not considered. Despite this, BCC achieves audio quality reflected in an average MUSHRA score of about 87 (i.e., "excellent" audio quality) on average and up to nearly 100 for certain audio signals.

The often-achieved perceptually small difference between reference signal and synthesized signal implies that cues related to a wide range of auditory spatial image attributes are implicitly considered by synthesizing ICTD, ICLD, and ICC at regular time intervals. In the following, some arguments are given on how ICTD, ICLD, and ICC may relate to a range of auditory spatial image attributes.

Estimation of Spatial Cues

In the following, it is described how ICTD, ICLD, and ICC are estimated. The bitrate for transmission of these (quantized and coded) spatial cues can be just a few kb/s and thus, with BCC, it is possible to transmit stereo and multi-channel audio signals at bitrates close to what is required for a single audio channel.

Figure 5:
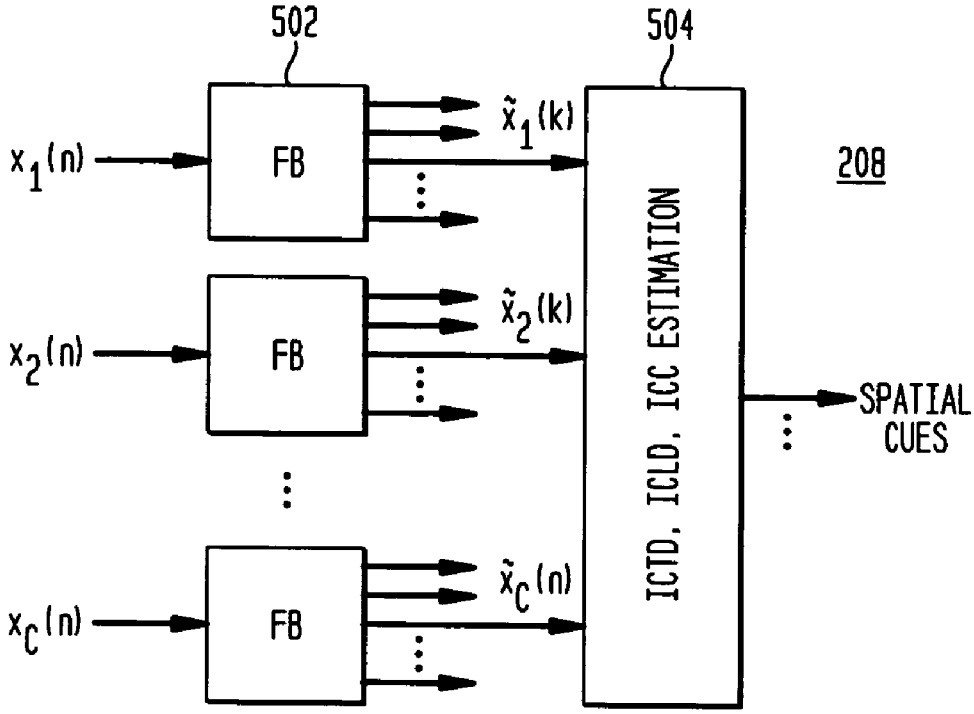
FIG. 5 shows a block diagram of the BCC estimator of FIG. 2, according to one embodiment of the present invention.

FIG. 5 shows a block diagram of BCC estimator 208 of FIG. 2, according to one embodiment of the present invention. BCC estimator 208 comprises filterbanks (FB) 502, which may be the same as filterbanks 302 of FIG. 3, and estimation block 504, which generates ICTD, ICLD, and ICC spatial cues for each different frequency subband generated by filterbanks 502.

Estimation of ICTD, ICLD, and ICC for Stereo Signals

The following measures are used for ICTD, ICLD, and ICC for corresponding subband signals $\tilde{x}_1(k)$ and $\tilde{x}_2(k)$ of two (e.g., stereo) audio channels:

*ICTD* [samples]:

$$\tau_{12}(k) = \arg\max_d \{\Phi_{12}(d, k)\}, \tag{7}$$

with a short-time estimate of the normalized cross-correlation function given by Equation (8) as follows:

$$\Phi_{12}(d, k) = \frac{p_{\tilde{x}_1\tilde{x}_2}(d, k)}{\sqrt{p_{\tilde{x}_1}(k - d_1)p_{\tilde{x}_2}(k - d_2)}}, \tag{8}$$

where $$d_1 = \max\{-d, 0\} \tag{9}$$

$$d_2 = \max\{d, 0\},$$

and $p_{\tilde{x}_1\tilde{x}_2}(d, k)$ is a short-time estimate of the mean of $\tilde{x}_1(k-d_1)\tilde{x}_2(k-d_2)$.

*ICLD* [dB]:

$$\Delta L_{12}(k) = 10\log_{10}\left(\frac{p_{\tilde{x}_2}(k)}{p_{\tilde{x}_1}(k)}\right). \tag{10}$$

*ICC*:

$$c_{12}(k) = \max_d |\Phi_{12}(d, k)|. \tag{11}$$

Note that the absolute value of the normalized cross-correlation is considered and $c_{12}$ (k) has a range of [0,1].

Estimation of ICTD, ICLD, and ICC for Multi-Channel Audio Signals

Figure 6:
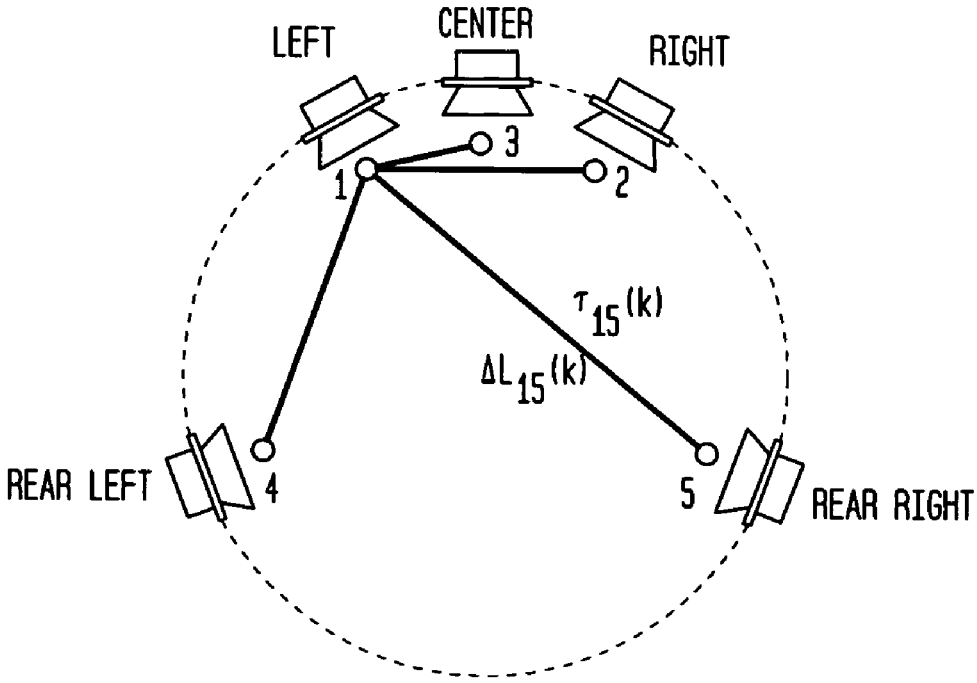
FIG. 6 illustrates the generation of ICTD and ICLD data for five-channel audio.

When there are more than two input channels, it is typically sufficient to define ICTD and ICLD between a reference channel (e.g., channel number 1) and the other channels, as illustrated in FIG. 6 for the case of C=5 channels, where $\tau_{1c}$(k) and $\Delta L_{12}$ (k) denote the ICTD and ICLD, respectively, between the reference channel 1 and channel c.

Figure 7A:
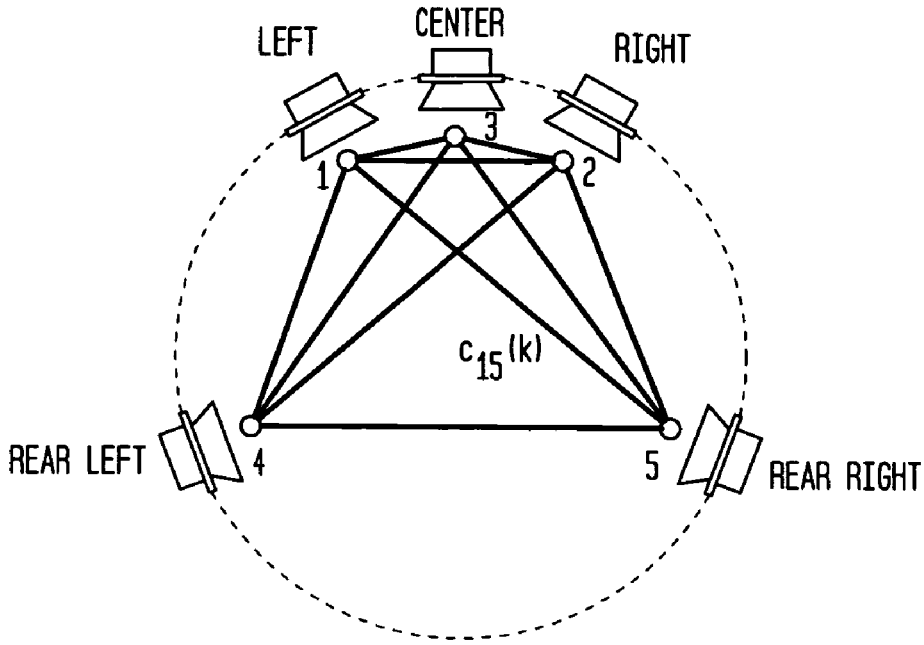
FIG. 7 illustrates the generation of ICC data for five-channel audio.
Figure 7B:
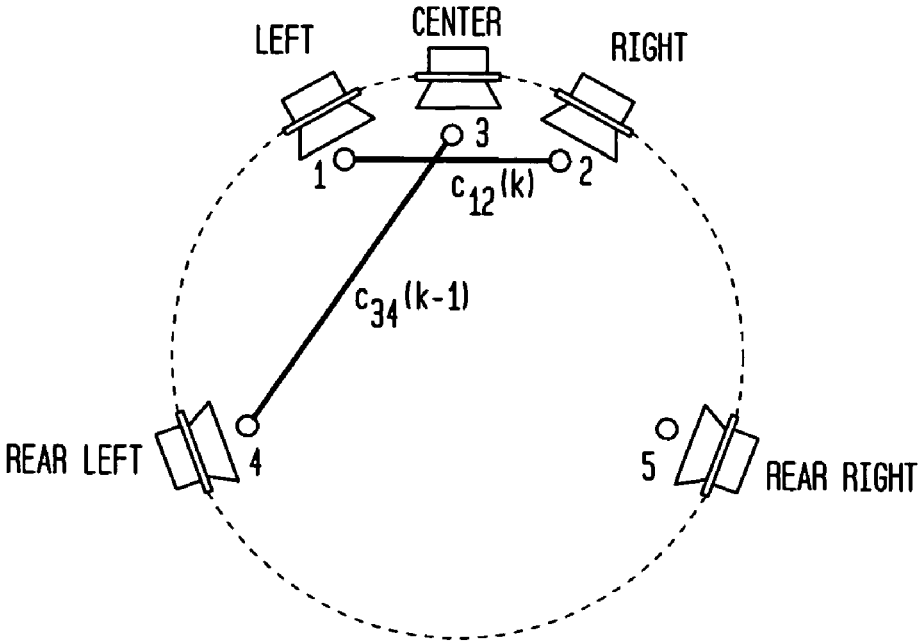

As opposed to ICTD and ICLD, ICC typically has more degrees of freedom. The ICC as defined can have different values between all possible input channel pairs. For C channels, there are C(C−1)/2 possible channel pairs; e.g., for 5 channels there are 10 channel pairs as illustrated in FIG. 7(*a*). However, such a scheme requires that, for each subband at each time index, C(C−1)/2 ICC values are estimated and transmitted, resulting in high computational complexity and high bitrate.

Alternatively, for each subband, ICTD and ICLD determine the direction at which the auditory event of the corresponding signal component in the subband is rendered. One single ICC parameter per subband may then be used to describe the overall coherence between all audio channels. Good results can be obtained by estimating and transmitting ICC cues only between the two channels with most energy in each subband at each time index. This is illustrated in FIG. 7(*b*), where for time instants k−1 and k the channel pairs (3, 4) and (1, 2) are strongest, respectively. A heuristic rule may be used for determining ICC between the other channel pairs.

Synthesis of Spatial Cues

Figure 8:
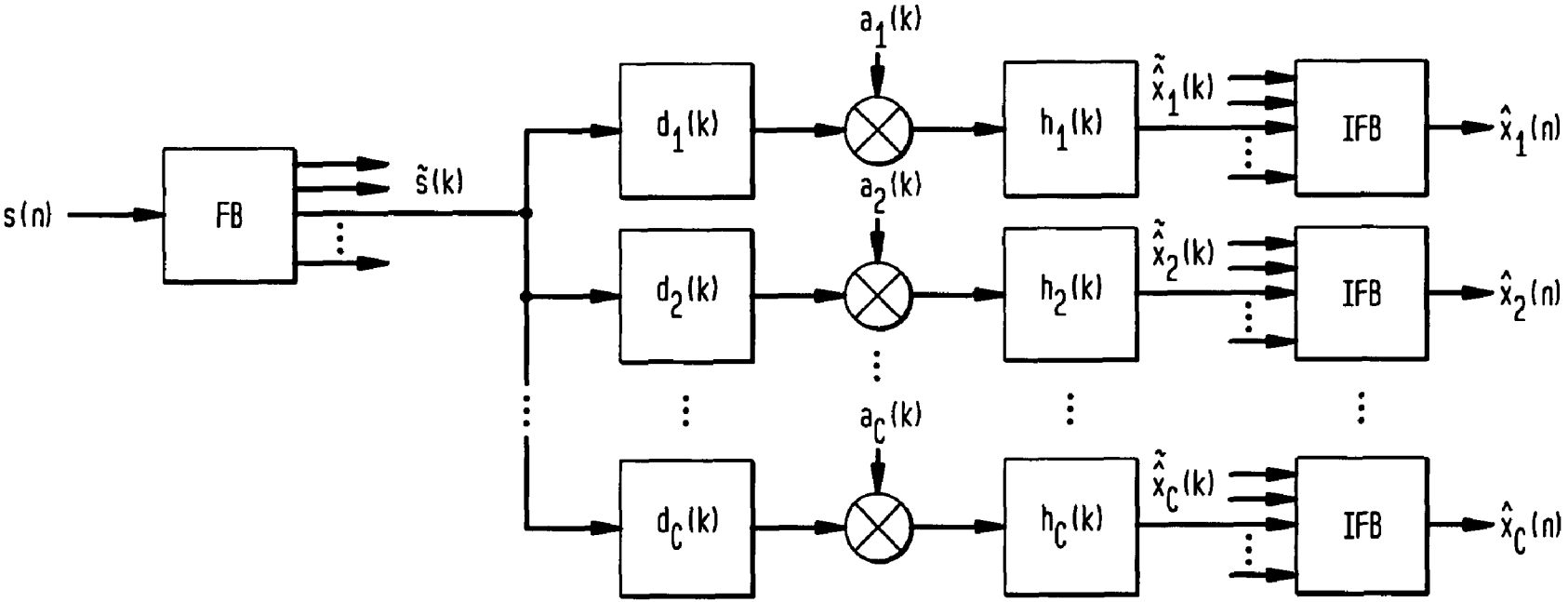
FIG. 8 shows a block diagram of an implementation of the BCC synthesizer of FIG. 4 that can be used in a BCC decoder to generate a stereo or multi-channel audio signal given a single transmitted sum signal s(n) plus the spatial cues.

FIG. 8 shows a block diagram of an implementation of BCC synthesizer 400 of FIG. 4 that can be used in a BCC decoder to generate a stereo or multi-channel audio signal given a single transmitted sum signal s(n) plus the spatial cues. The sum signal s(n) is decomposed into subbands, where $\tilde{s}$(k) denotes one such subband. For generating the corresponding subbands of each of the output channels, delays $d_c$, scale factors $a_c$, and filters $h_c$ are applied to the corresponding subband of the sum signal. (For simplicity of notation, the time index k is ignored in the delays, scale factors, and filters.) ICTD are synthesized by imposing delays, ICLD by scaling, and ICC by applying de-correlation filters. The processing shown in FIG. 8 is applied independently to each subband.

ICTD Synthesis

The delays $d_c$ are determined from the ICTDs $\tau_{1c}$(k), according to Equation (12) as follows:

$$d_c = \begin{cases} -\frac{1}{2}(\max_{2\le l\le C}\tau_{1l}(k) + \min_{2\le l\le C}\tau_{1l}(k)), & c = 1 \\ \tau_{1l}(k) + d_1 & 2 \le c \le C. \end{cases} \tag{12}$$

The delay for the reference channel, $d_1$, is computed such that the maximum magnitude of the delays $d_c$ is minimized. The less the subband signals are modified, the less there is a danger for artifacts to occur. If the subband sampling rate does not provide high enough time-resolution for ICTD synthesis, delays can be imposed more precisely by using suitable all-pass filters.

ICLD Synthesis

In order that the output subband signals have desired ICLDs $\Delta L_{12}$ (k) between channel c and the reference channel 1, the gain factors $a_c$ should satisfy Equation (13) as follows:

$$\frac{a_c}{a_1} = 10^{-\frac{\Delta L_{1c}(k)}{20}}. \tag{13}$$

Additionally, the output subbands are preferably normalized such that the sum of the power of all output channels is equal to the power of the input sum signal. Since the total original signal power in each subband is preserved in the sum signal, this normalization results in the absolute subband power for each output channel approximating the corresponding power of the original encoder input audio signal. Given these constraints, the scale factors $a_c$ are given by Equation (14) as follows:

$$a_c = \begin{cases} \dfrac{1}{\sqrt{1 + \sum_{i=2}^{C} 10^{\Delta L_{1i}/10}}}, & c = 1 \\ 10^{\Delta L_{1c}/20} a_1, & \text{otherwise.} \end{cases} \tag{14}$$

ICC Synthesis

In certain embodiments, the aim of ICC synthesis is to reduce correlation between the subbands after delays and scaling have been applied, without affecting ICTD and ICLD. This can be achieved by designing the filters $h_c$ in FIG. 8 such that ICTD and ICLD are effectively varied as a function of frequency such that the average variation is zero in each subband (auditory critical band).

Figure 9:
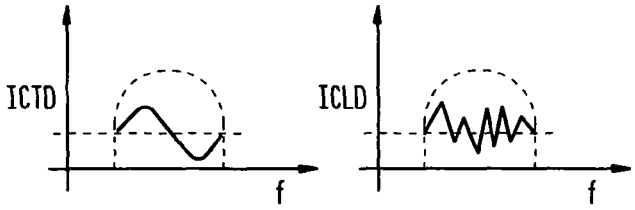
FIG. 9 illustrates how ICTD and ICLD are varied within a subband as a function of frequency.

FIG. 9 illustrates how ICTD and ICLD are varied within a subband as a function of frequency. The amplitude of ICTD and ICLD variation determines the degree of de-correlation and is controlled as a function of ICC. Note that ICTD are varied smoothly (as in FIG. 9(*a*)), while ICLD are varied randomly (as in FIG. 9(*b*)). One could vary ICLD as smoothly as ICTD, but this would result in more coloration of the resulting audio signals.

Another method for synthesizing ICC, particularly suitable for multi-channel ICC synthesis, is described in more detail in C. Faller, "Parametric multi-channel audio coding: Synthesis of coherence cues," *IEEE Trans. on Speech and Audio Proc.*, 2003, the teachings of which are incorporated herein by reference. As a function of time and frequency, specific amounts of artificial late reverberation are added to each of the output channels for achieving a desired ICC. Additionally, spectral modification can be applied such that the spectral envelope of the resulting signal approaches the spectral envelope of the original audio signal.

Other related and unrelated ICC synthesis techniques for stereo signals (or audio channel pairs) have been presented in E. Schuijers, W. Oomen, B. den Brinker, and J. Breebaart, "Advances in parametric coding for high-quality audio," in *Preprint* 114$^{th}$ *Conv. Aud. Eng. Soc.*, March 2003, and J. Engdegard, H. Purnhagen, J. Roden, and L. Liljeryd, "Synthetic ambience in parametric stereo coding," in *Preprint*

117th *Conv. Aud. Eng. Soc.*, May 2004, the teachings of both of which are incorporated here by reference.

C-to-E BCC

As described previously, BCC can be implemented with more than one transmission channel. A variation of BCC has been described which represents C audio channels not as one single (transmitted) channel, but as E channels, denoted C-to-E BCC. There are (at least) two motivations for C-to-E BCC:

- BCC with one transmission channel provides a backwards compatible path for upgrading existing mono systems for stereo or multi-channel audio playback. The upgraded systems transmit the BCC downmixed sum signal through the existing mono infrastructure, while additionally transmitting the BCC side information. C-to-E BCC is applicable to E-channel backwards compatible coding of C-channel audio.
- C-to-E BCC introduces scalability in terms of different degrees of reduction of the number of transmitted channels. It is expected that the more audio channels that are transmitted, the better the audio quality will be.

Signal processing details for C-to-E BCC, such as how to define the ICTD, ICLD, and ICC cues, are described in U.S. application Ser. No. 10/762,100, filed on Jan. 20, 2004 (Faller 13-1).

Diffuse Sound Shaping

In certain implementations, BCC coding involves algorithms for ICTD, ICLD, and ICC synthesis. ICC cues can be synthesized by means of de-correlating the signal components in the corresponding subbands. This can be done by frequency-dependent variation of ICLD, frequency-dependent variation of ICTD and ICLD, all-pass filtering, or with ideas related to reverberation algorithms.

When these techniques are applied to audio signals, the temporal envelope characteristics of the signals are not preserved. Specifically, when applied to transients, the instantaneous signal energy is likely to be spread over a certain period of time. This results in artifacts such as "pre-echoes" or "washed-out transients."

A generic principle of certain embodiments of the present invention relates to the observation that the sound synthesized by a BCC decoder should not only have spectral characteristics that are similar to that of the original sound, but also resemble the temporal envelope of the original sound quite closely in order to have similar perceptual characteristics. Generally, this is achieved in BCC-like schemes by including a dynamic ICLD synthesis that applies a time-varying scaling operation to approximate each signal channel's temporal envelope. For the case of transient signals (attacks, percussive instruments, etc.), the temporal resolution of this process may, however, not be sufficient to produce synthesized signals that approximate the original temporal envelope closely enough. This section describes a number of approaches to do this with a sufficiently fine time resolution.

Furthermore, for BCC decoders that do not have access to the temporal envelope of the original signals, the idea is to take the temporal envelope of the transmitted "sum signal(s)" as an approximation instead. As such, there is no side information necessary to be transmitted from the BCC encoder to the BCC decoder in order to convey such envelope information. In summary, the invention relies on the following principle:

- The transmitted audio channels (i.e., "sum channel(s)")—or linear combinations of these channels which BCC synthesis may be based on—are analyzed by a temporal envelope extractor for their temporal envelope with a high time resolution (e.g., significantly finer than the BCC block size).
- The subsequent synthesized sound for each output channel is shaped such that—even after ICC synthesis—it matches the temporal envelope determined by the extractor as closely as possible. This ensures that, even in the case of transient signals, the synthesized output sound is not significantly degraded by the ICC synthesis/signal de-correlation process.

Figure 10:
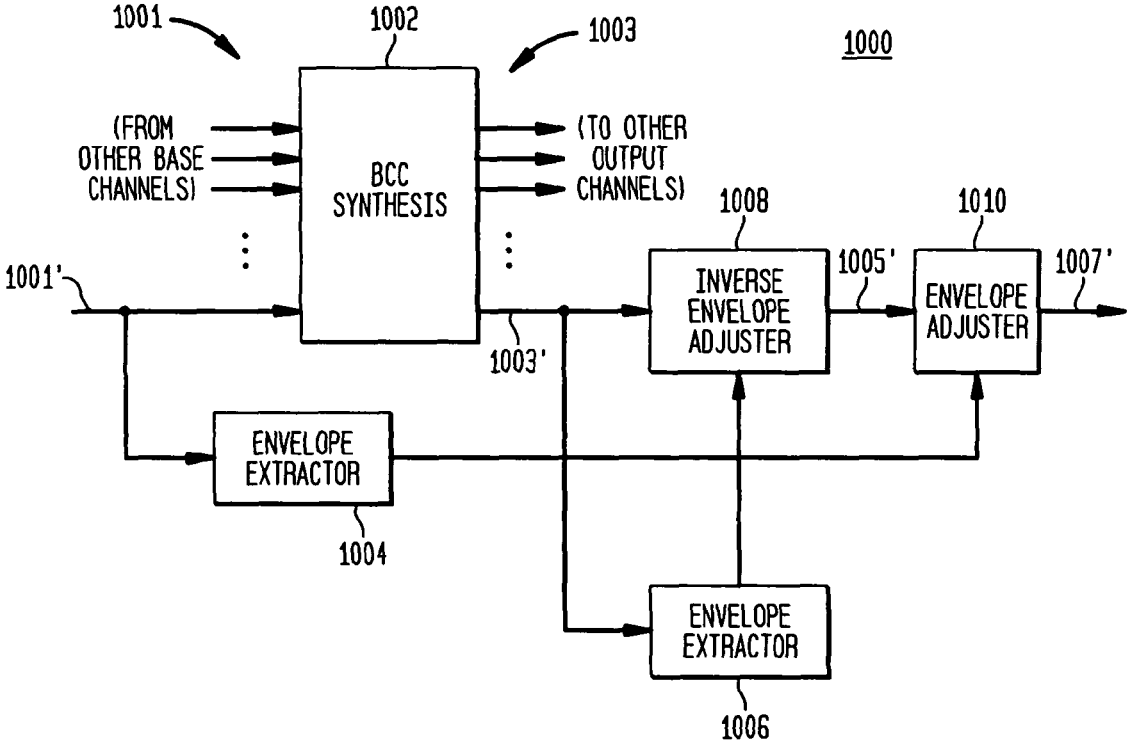
FIG. 10 shows a block diagram representing at least a portion of a BCC decoder, according to one embodiment of the present invention.

FIG. 10 shows a block diagram representing at least a portion of a BCC decoder 1000, according to one embodiment of the present invention. In FIG. 10, block 1002 represents BCC synthesis processing that includes, at least, ICC synthesis. BCC synthesis block 1002 receives base channels 1001 and generates synthesized channels 1003. In certain implementations, block 1002 represents the processing of blocks 406, 408, and 410 of FIG. 4, where base channels 1001 are the signals generated by upmixing block 404 and synthesized channels 1003 are the signals generated by correlation block 410. FIG. 10 represents the processing implemented for one base channel 1001' and its corresponding synthesized channel. Similar processing is also applied to each other base channel and its corresponding synthesized channel.

Envelope extractor 1004 determines the fine temporal envelope a of base channel 1001', and envelope extractor 1006 determines the fine temporal envelope b of synthesized channel 1003'. Inverse envelope adjuster 1008 uses temporal envelope b from envelope extractor 1006 to normalize the envelope (i.e., "flatten" the temporal fine structure) of synthesized channel 1003' to produce a flattened signal 1005' having a flat (e.g., uniform) time envelope. Depending on the particular implementation, the flattening can be applied either before or after upmixing. Envelope adjuster 1010 uses temporal envelope a from envelope extractor 1004 to re-impose the original signal envelope on the flattened signal 1005' to generate output signal 1007' having a temporal envelope substantially equal to the temporal envelope of base channel 1001.

Depending on the implementation, this temporal envelope processing (also referred to herein as "envelope shaping") may be applied to the entire synthesized channel (as shown) or only to the orthogonalized part (e.g., late-reverberation part, de-correlated part) of the synthesized channel (as described subsequently). Moreover, depending on the implementation, envelope shaping may be applied either to time-domain signals or in a frequency-dependent fashion (e.g., where the temporal envelope is estimated and imposed individually at different frequencies).

Inverse envelope adjuster 1008 and envelope adjuster 1010 may be implemented in different ways. In one type of implementation, a signal's envelope is manipulated by multiplication of the signal's time-domain samples (or spectral/subband samples) with a time-varying amplitude modification function (e.g., 1/b for inverse envelope adjuster 1008 and a for envelope adjuster 1010). Alternatively, a convolution/filtering of the signal's spectral representation over frequency can be used in a manner analogous to that used in the prior art for the purpose of shaping the quantization noise of a low bitrate audio coder. Similarly, the temporal envelope of signals may be extracted either directly by analysis the signal's time structure or by examining the autocorrelation of the signal spectrum over frequency.

Figures 11A, 11B, 11C:
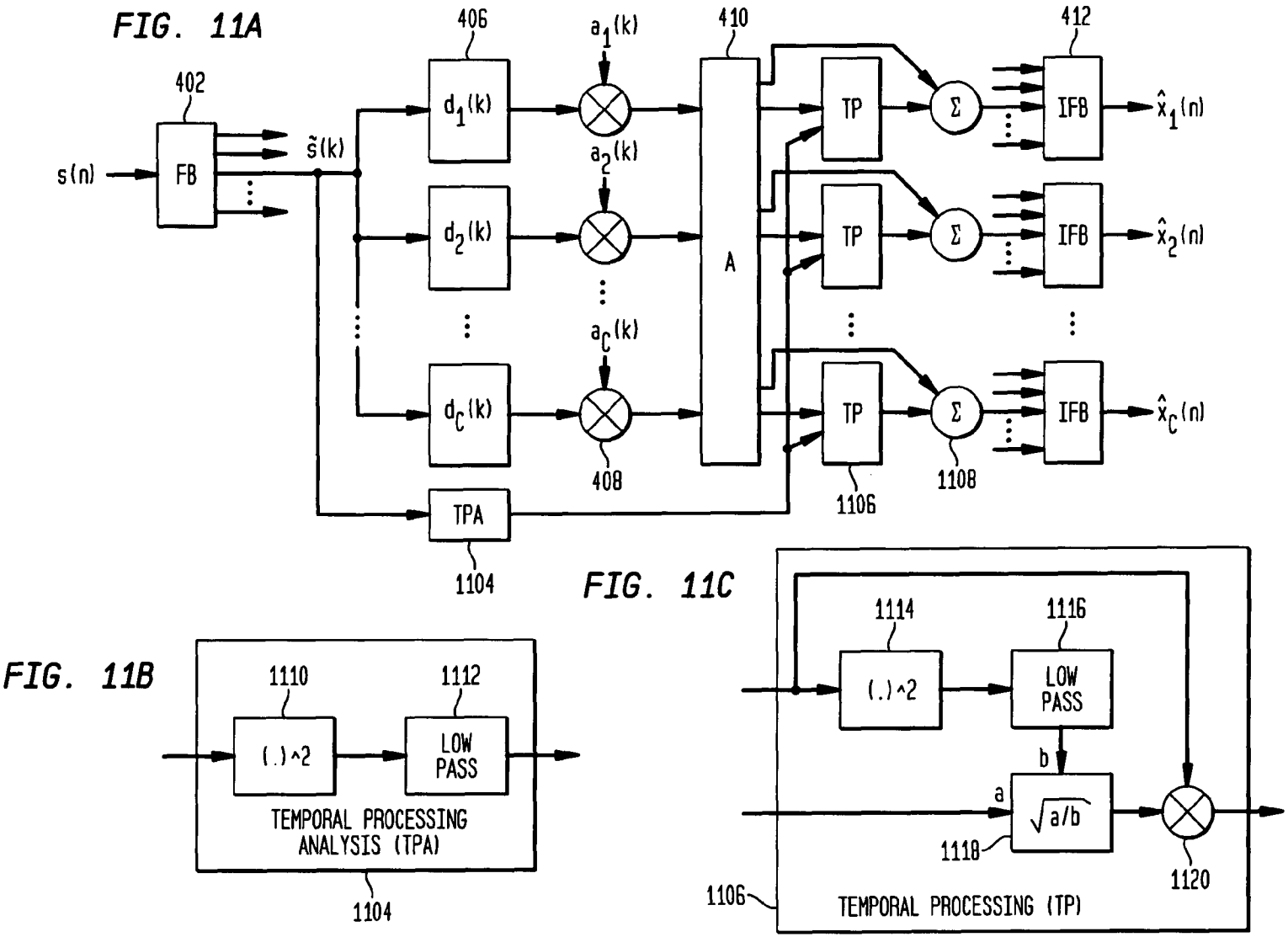
FIG. 11 illustrates an exemplary application of the envelope shaping scheme of FIG. 10 in the context of the BCC synthesizer of FIG. 4.

FIG. 11 illustrates an exemplary application of the envelope shaping scheme of FIG. 10 in the context of BCC synthesizer 400 of FIG. 4. In this embodiment, there is a single transmitted sum signal s(n), the C base signals are generated by replicating that sum signal, and envelope shaping is individually applied to different subbands. In alternative embodiments, the order of delays, scaling, and other processing may be different. Moreover, in alternative embodiments, envelope shaping is not restricted to processing each subband independently. This is especially true for convolution/filtering-based implementations that exploit covariance over frequency bands to derive information on the signal's temporal fine structure.

In FIG. 11(*a*), temporal process analyzer (TPA) 1104 is analogous to envelope extractor 1004 of FIG. 10, and each temporal processor (TP) 1106 is analogous to the combination of envelope extractor 1006, inverse envelope adjuster 1008, and envelope adjuster 1010 of FIG. 10.

FIG. 11(*b*) shows a block diagram of one possible time domain-based implementation of TPA 1104 in which the base signal samples are squared (1110) and then low-pass filtered (1112) to characterize the temporal envelope a of the base signal.

FIG. 11(*c*) shows a block diagram of one possible time domain-based implementation of TP 1106 in which the synthesized signal samples are squared (1114) and then low-pass filtered (1116) to characterize the temporal envelope b of the synthesized signal. A scale factor (e.g., sqrt (a/b)) is generated (1118) and then applied (1120) to the synthesized signal to generate an output signal having a temporal envelope substantially equal to that of the original base channel.

In alternative implementations of TPA 1104 and TP 1106, the temporal envelopes are characterized using magnitude operations rather than by squaring the signal samples. In such implementations, the ratio a/b may be used as the scale factor without having to apply the square root operation.

Although the scaling operation of FIG. 11(*c*) corresponds to a time domain-based implementation of TP processing, TP processing (as well as TPA and inverse TP (ITP) processing) can also be implemented using frequency-domain signals, as in the embodiment of FIGS. 17-18 (described below). As such, for purposes of this specification, the term "scaling function" should be interpreted to cover either time-domain or frequency-domain operations, such as the filtering operations of FIGS. 18(*b*) and (*c*).

In general, TPA 1104 and TP 1106 are preferably designed such that they do not modify signal power (i.e., energy). Depending on the particular implementation, this signal power may be a short-time average signal power in each channel, e.g., based on the total signal power per channel in the time period defined by the synthesis window or some other suitable measure of power. As such, scaling for ICLD synthesis (e.g., using multipliers 408) can be applied before or after envelope shaping.

Note that in FIG. 11(*a*), for each channel, there are two outputs, where TP processing is applied to only one of them. This reflects an ICC synthesis scheme that mixes two signal components: unmodified and orthogonalized signals, where the ratio of unmodified and orthogonalized signal components determines the ICC. In the embodiment shown in FIG. 11(*a*), TP is applied to only the orthogonalized signal component, where summation nodes 1108 recombine the unmodified signal components with the corresponding temporally shaped, orthogonalized signal components.

Figure 12A:
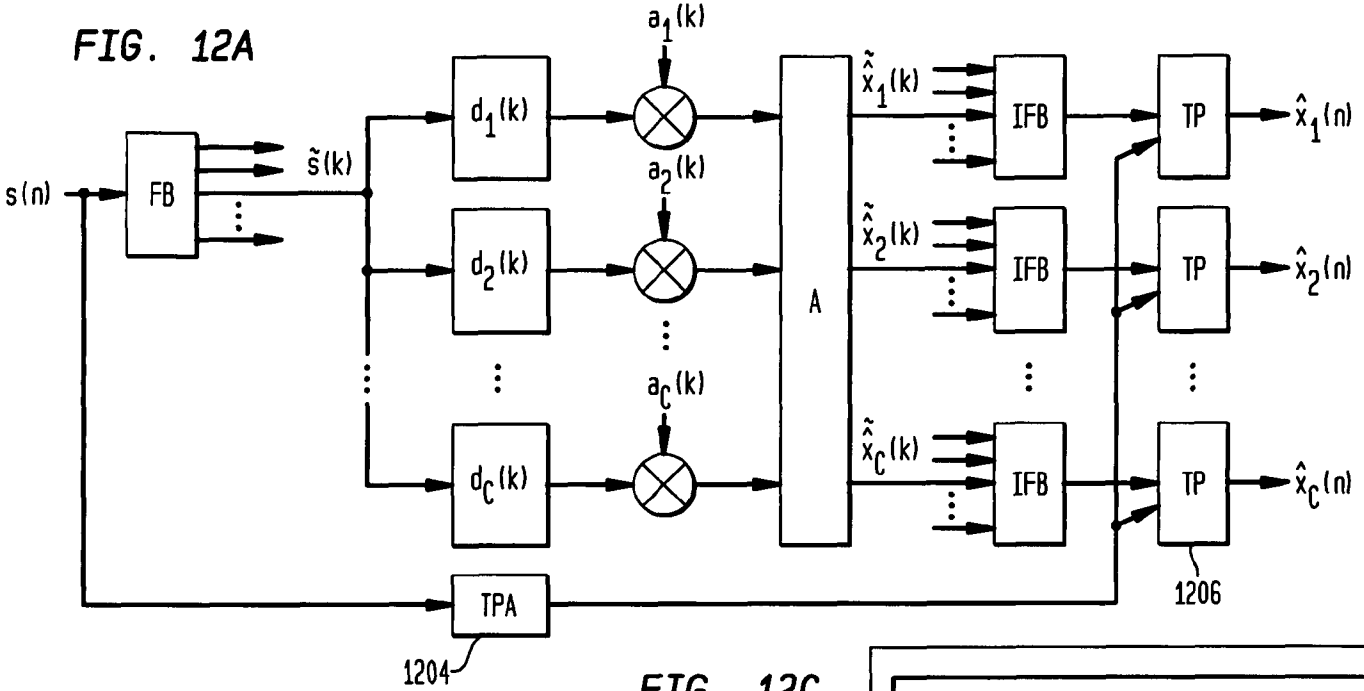
FIG. 12 illustrates an alternative exemplary application of the envelope shaping scheme of FIG. 10 in the context of the BCC synthesizer of FIG. 4, where envelope shaping is applied to in the time domain.
Figure 12C:
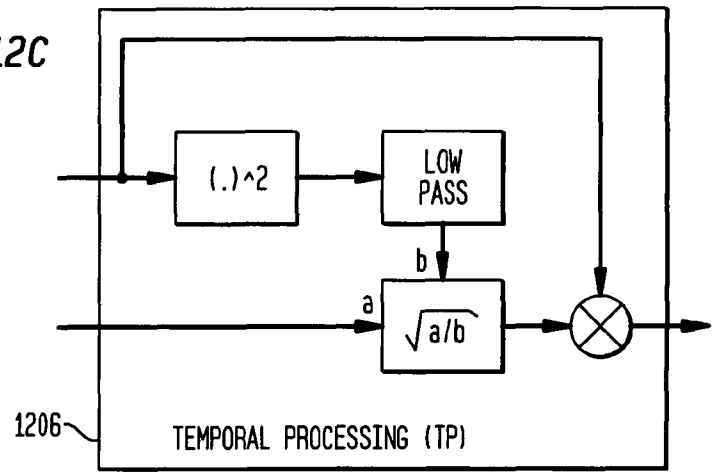
Figure 12B:
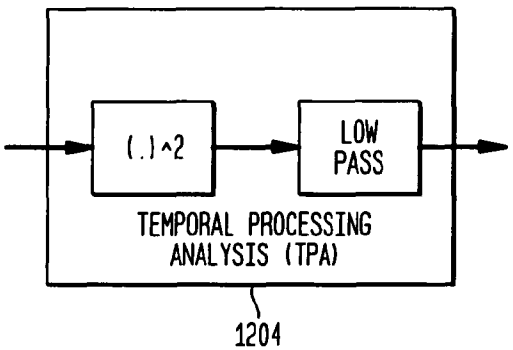

FIG. 12 illustrates an alternative exemplary application of the envelope shaping scheme of FIG. 10 in the context of BCC synthesizer 400 of FIG. 4, where envelope shaping is applied to in the time domain. Such an embodiment may be warranted when the time resolution of the spectral representation in which ICTD, ICLD, and ICC synthesis is carried out is not high enough for effectively preventing "pre-echoes" by imposing the desired temporal envelope. For example, this may be the case when BCC is implemented with a short-time Fourier transform (STFT).

As shown in FIG. 12(*a*), TPA 1204 and each TP 1206 are implemented in the time domain, where the full-band signal is scaled such that it has the desired temporal envelope (e.g., the envelope as estimated from the transmitted sum signal). FIGS. 12(*b*) and (*c*) shows possible implementations of TPA 1204 and TP 1206 that are analogous to those shown in FIGS. 11(*b*) and (*c*).

In this embodiment, TP processing is applied to the output signal, not only to the orthogonalized signal components. In alternative embodiments, time domain-based TP processing can be applied just to the orthogonalized signal components if so desired, in which case unmodified and orthogonalized subbands would be converted to the time domain with separate inverse filterbanks.

Since full-band scaling of the BCC output signals may result in artifacts, envelope shaping might be applied only at specified frequencies, for example, frequencies larger than a certain cut-off frequency $f_{TP}$ (e.g., 500 Hz). Note that the frequency range for analysis (TPA) may differ from the frequency range for synthesis (TP).

Figure 13A:
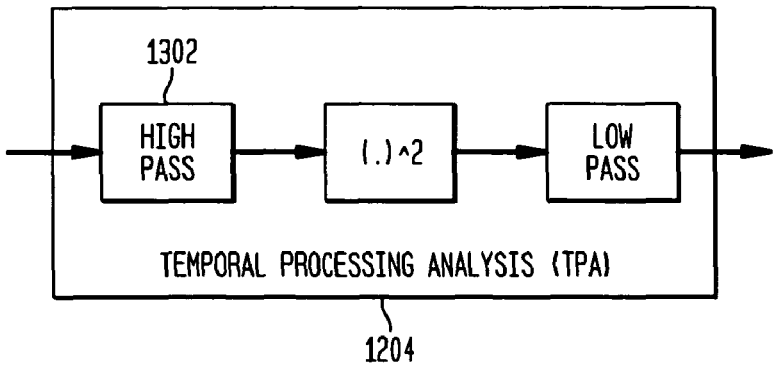
FIGS. 13(*a*) and (*b*) show possible implementations of the TPA and the TP of FIG. 12, where envelope shaping is applied only at frequencies higher than the cut-off frequency $f_{TP}$.
Figure 13B:
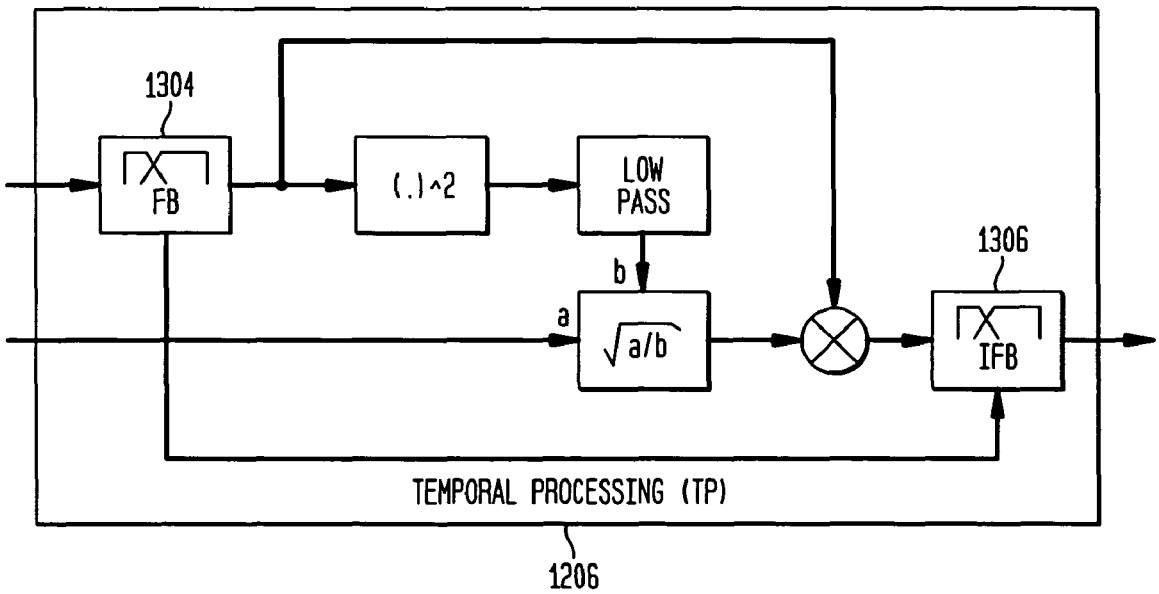

FIGS. 13(*a*) and (*b*) show possible implementations of TPA 1204 and TP 1206 where envelope shaping is applied only at frequencies higher than the cut-off frequency $f_{TP}$. In particular, FIG. 13(*a*) shows the addition of high-pass filter 1302, which filters out frequencies lower than $f_{TP}$ prior to temporal envelope characterization. FIG. 13(*b*) shows the addition of two-band filterbank 1304 having with a cut-off frequency of $f_{TP}$ between the two subbands, where only the high-frequency part is temporally shaped. Two-band inverse filterbank 1306 then recombines the low-frequency part with the temporally shaped, high-frequency part to generate the output signal.

Figure 14:
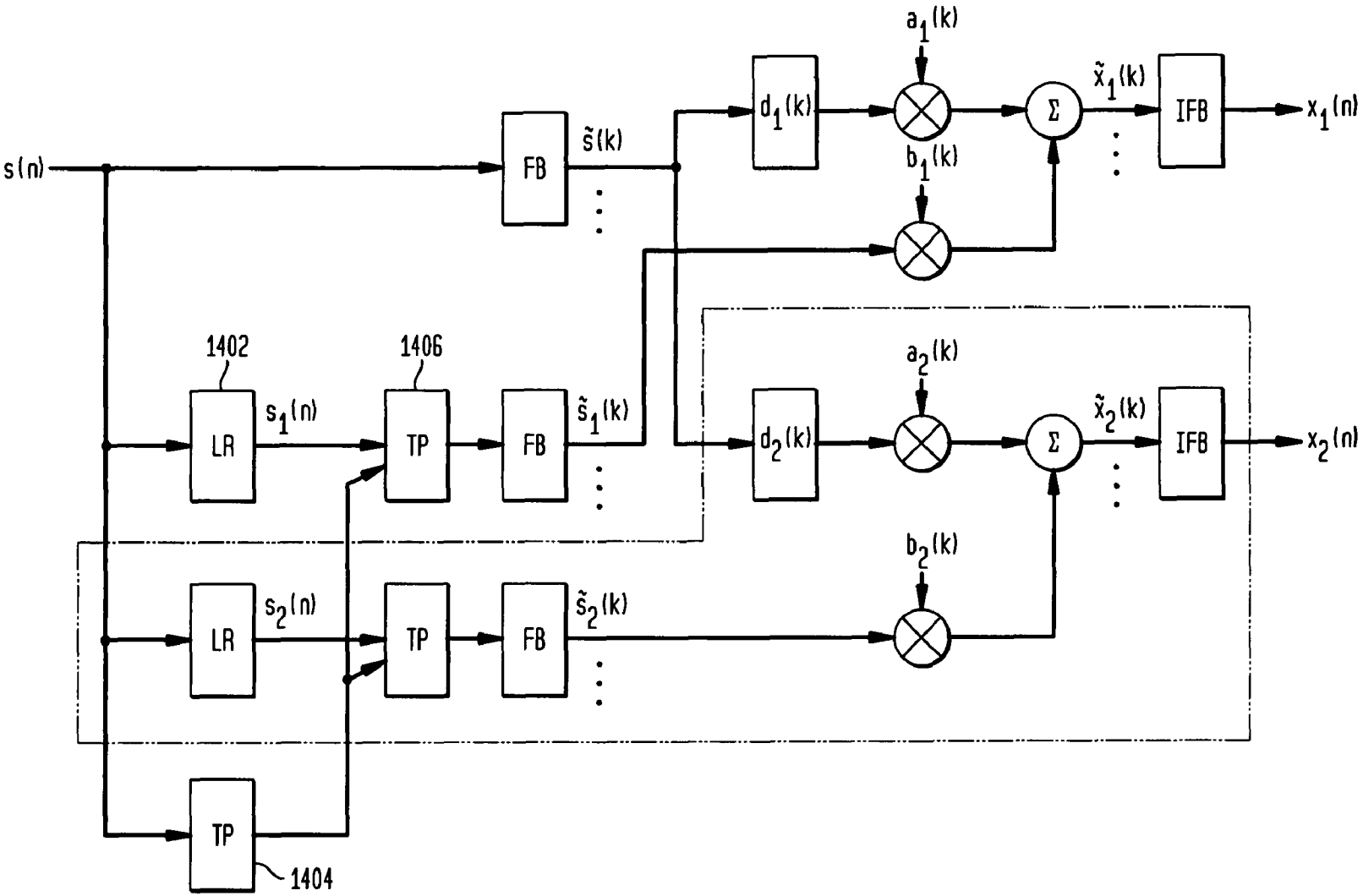
FIG. 14 illustrates an exemplary application of the envelope shaping scheme of FIG. 10 in the context of the late reverberation-based ICC synthesis scheme described in U.S. application Ser. No. 10/815,591, filed on Apr. 1, 2004 as attorney docket no. Baumgarte 7-12.

FIG. 14 illustrates an exemplary application of the envelope shaping scheme of FIG. 10 in the context of the late reverberation-based ICC synthesis scheme described in U.S. application Ser. No. 10/815,591, filed on Apr. 1, 2004 as attorney docket no. Baumgarte 7-12. In this embodiment, TPA 1404 and each TP 1406 are applied in the time domain, as in FIG. 12 or FIG. 13, but where each TP 1406 is applied to the output from a different late reverberation (LR) block 1402.

Figure 15:
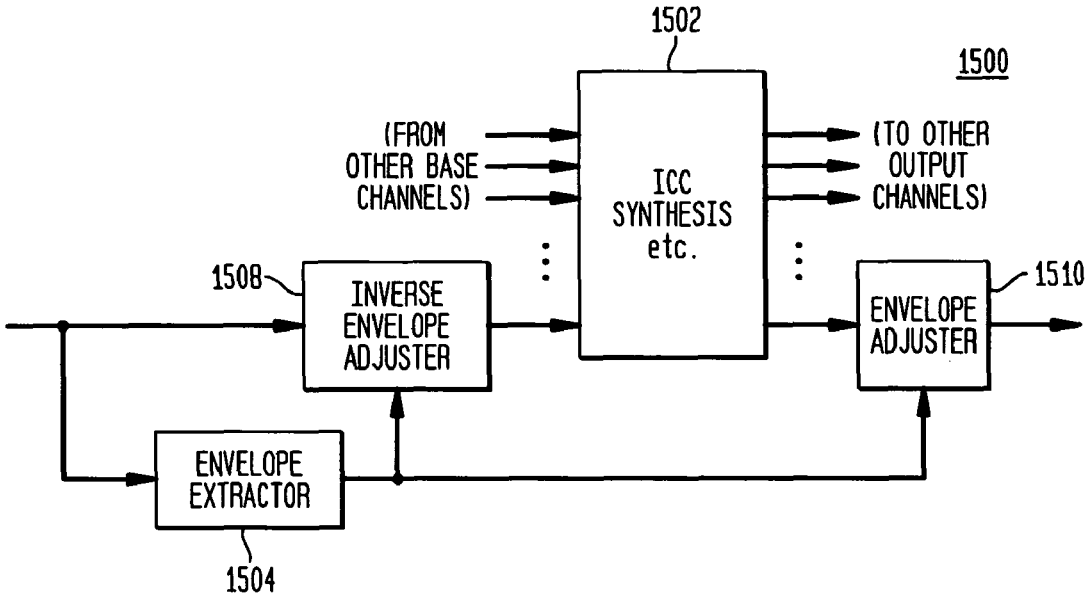
FIG. 15 shows a block diagram representing at least a portion of a BCC decoder, according to an embodiment of the present invention that is an alternative to the scheme shown in FIG. 10.

FIG. 15 shows a block diagram representing at least a portion of a BCC decoder 1500, according to an embodiment of the present invention that is an alternative to the scheme shown in FIG. 10. In FIG. 15, BCC synthesis block 1502, envelope extractor 1504, and envelope adjuster 1510 are analogous to BCC synthesis block 1002, envelope extractor 1004, and envelope adjuster 1010 of FIG. 10. In FIG. 15, however, inverse envelope adjuster 1508 is applied prior to BCC synthesis, rather than after BCC synthesis, as in FIG. 10. In this way, inverse envelope adjuster 1508 flattens the base channel before BCC synthesis is applied.

Figure 16:
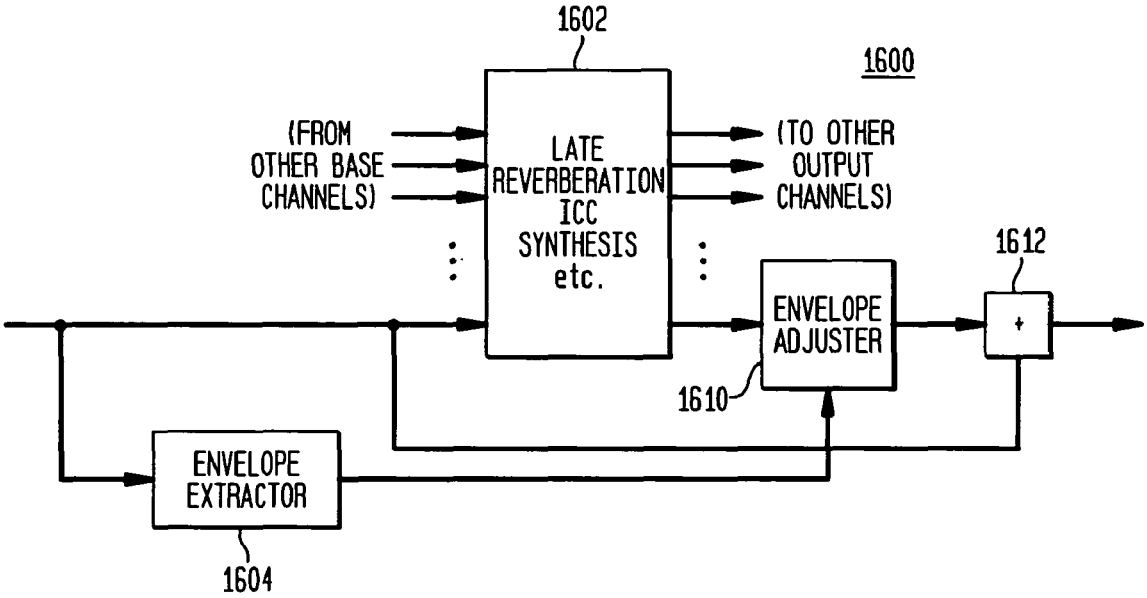
FIG. 16 shows a block diagram representing at least a portion of a BCC decoder, according to an embodiment of the present invention that is an alternative to the schemes shown in FIGS. 10 and 15.

FIG. 16 shows a block diagram representing at least a portion of a BCC decoder 1600, according to an embodiment of the present invention that is an alternative to the schemes shown in FIGS. 10 and 15. In FIG. 16, envelope extractor 1604 and envelope adjuster 1610 are analogous to envelope extractor 1504 and envelope adjuster 1510 of FIG. 15. In the embodiment of FIG. 15, however, synthesis block 1602 represents late reverberation-based ICC synthesis similar to that shown in FIG. 16. In this case, envelope shaping is applied only to the uncorrelated late-reverberation signal, and summation node 1612 adds the temporally shaped, late-reverberation signal to the original base channel (which already has the desired temporal envelope). Note that, in this case, an inverse envelope adjuster does not need to be applied, because the late-reverberation signal has an approximately flat temporal envelope due to its generation process in block 1602.

Figure 17:
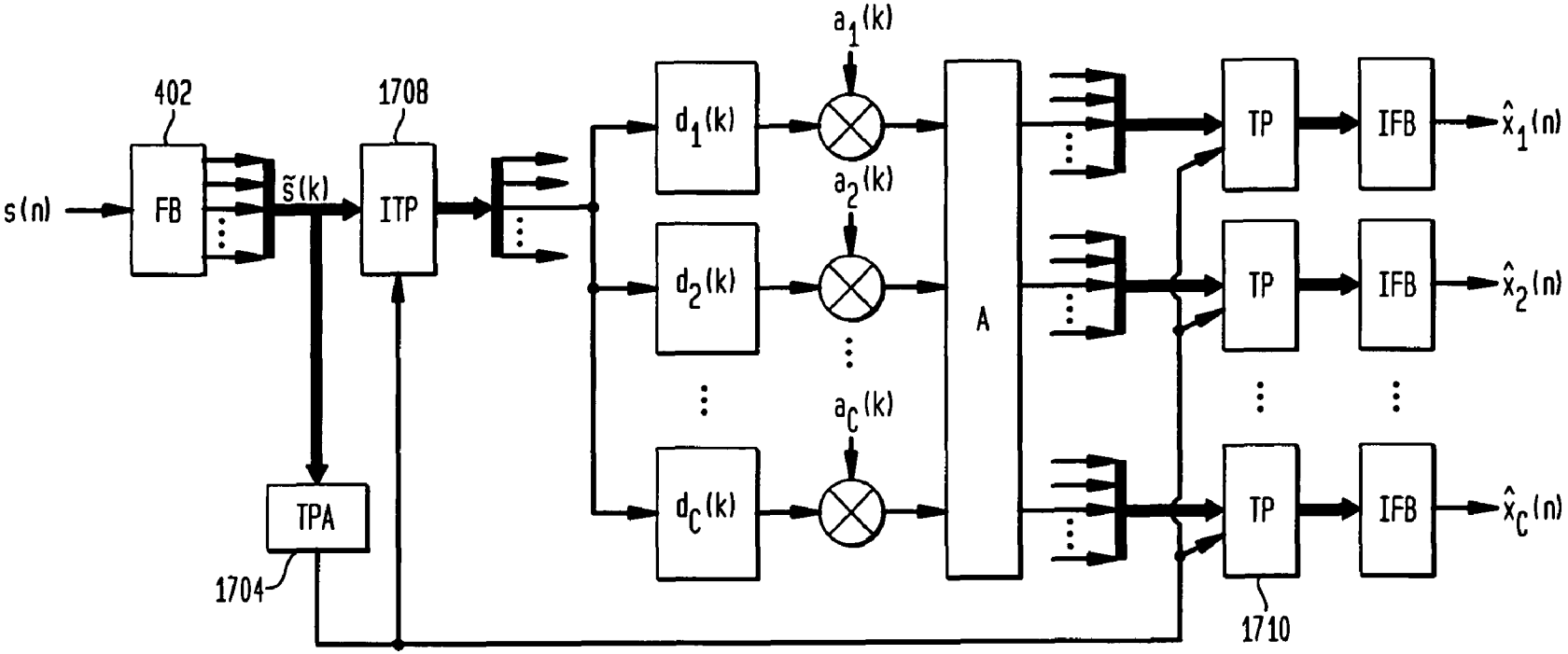
FIG. 17 illustrates an exemplary application of the envelope shaping scheme of FIG. 15 in the context of the BCC synthesizer of FIG. 4.

FIG. 17 illustrates an exemplary application of the envelope shaping scheme of FIG. 15 in the context of BCC synthesizer 400 of FIG. 4. In FIG. 17, TPA 1704, inverse TP (ITP) 1708, and TP 1710 are analogous to envelope extractor 1504, inverse envelope adjuster 1508, and envelope adjuster 1510 of FIG. 15.

In this frequency-based embodiment, envelope shaping of diffuse sound is implemented by applying a convolution to the frequency bins of (e.g., STFT) filterbank 402 along the frequency axis. Reference is made to U.S. Pat. No. 5,781,888 (Herre) and U.S. Pat. No. 5,812,971 (Herre), the teachings of which are incorporated herein by reference, for subject matter related to this technique.

Figure 18A:
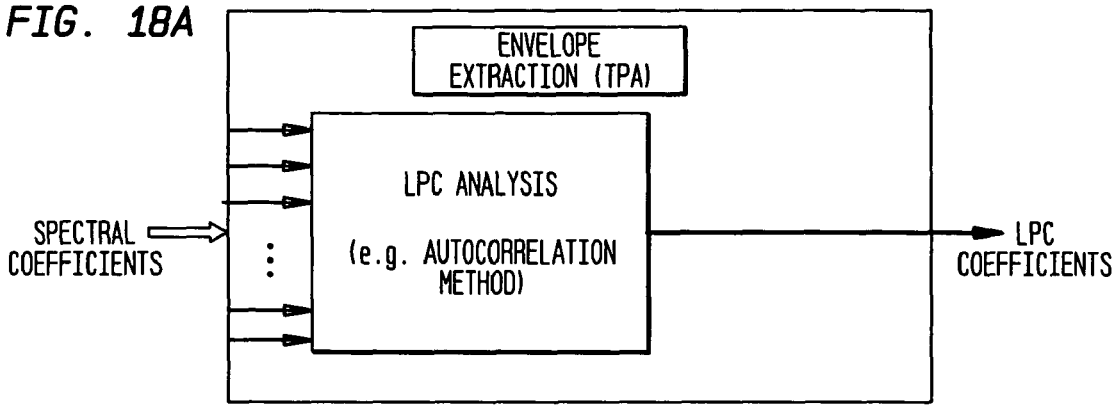
FIGS. 18(*a*)-(*c*) show block diagrams of possible implementations of the TPA, ITP, and TP of FIG. 17.
Figure 18B:
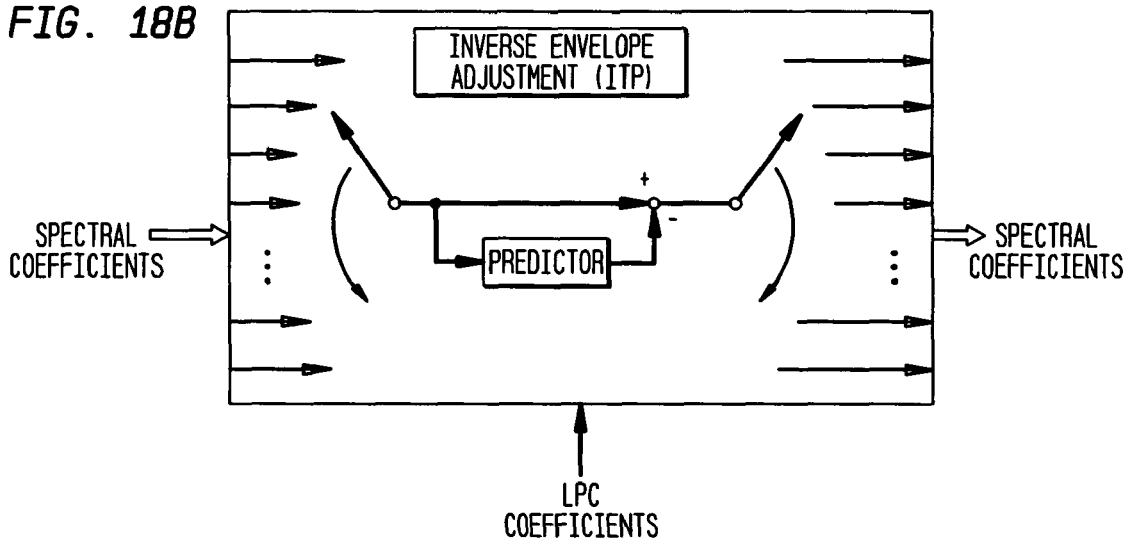
Figure 18C:
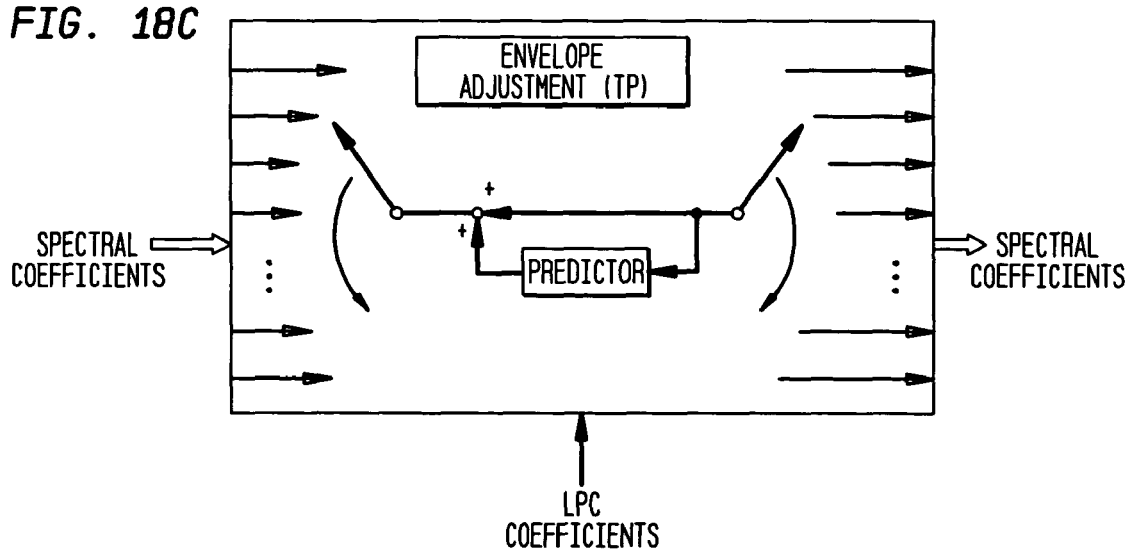

FIG. 18(*a*) shows a block diagram of one possible implementation of TPA 1704 of FIG. 17. In this implementation, TPA 1704 is implemented as a linear predictive coding (LPC) analysis operation that determines the optimum prediction coefficients for the series of spectral coefficients over frequency. Such LPC analysis techniques are well-known e.g., from speech coding and many algorithms for efficient calculation of LPC coefficients are known, such as the autocorrelation method (involving the calculation of the signal's autocorrelation function and a subsequent Levinson-Durbin recursion). As a result of this computation, a set of LPC coefficients are available at the output that represent the signal's temporal envelope.

FIGS. 18(*b*) and (*c*) show block diagrams of possible implementations of ITP 1708 and TP 1710 of FIG. 17. In both implementations, the spectral coefficients of the signal to be processed are processed in order of (increasing or decreasing) frequency, which is symbolized here by rotating switch circuitry, converting these coefficients into a serial order for processing by a predictive filtering process (and back again after this processing). In the case of ITP 1708, the predictive filtering calculates the prediction residual and in this way "flattens" the temporal signal envelope. In the case of TP 1710, the inverse filter re-introduces the temporal envelope represented by the LPC coefficients from TPA 1704.

For the calculation of the signal's temporal envelope by TPA 1704, it is important to eliminate the influence of the analysis window of filterbank 402, if such a window is used. This can be achieved by either normalizing the resulting envelope by the (known) analysis window shape or by using a separate analysis filterbank which does not employ an analysis window.

The convolution/filtering-based technique of FIG. 17 can also be applied in the context of the envelope shaping scheme of FIG. 16, where envelope extractor 1604 and envelope adjuster 1610 are based on the TPA of FIG. 18(*a*) and the TP of FIG. 18(*c*), respectively.

Further Alternative Embodiments

BCC decoders can be designed to selectively enable/disable envelope shaping. For example, a BCC decoder could apply a conventional BCC synthesis scheme and enable the envelope shaping when the temporal envelope of the synthesized signal fluctuates sufficiently such that the benefits of envelope shaping dominate over any artifacts that envelope shaping may generate. This enabling/disabling control can be achieved by:

(1) Transient detection: If a transient is detected, then TP processing is enabled. Transient detection can be implemented with in a look-ahead manner to effectively shape not only the transient but also the signal shortly before and after the transient. Possible ways of detecting transients include:

Observing the temporal envelope of the transmitted BCC sum signal(s) to determine when there is a sudden increase in power indicating the occurrence of a transient; and Examining the gain of the predictive (LPC) filter. If the LPC prediction gain exceeds a specified threshold, it can be assumed that the signal is transient or highly fluctuating. The LPC analysis is computed on the spectrum's autocorrelation.

(2) Randomness detection: There are scenarios when the temporal envelope is fluctuating pseudo-randomly. In such a scenario, no transient might be detected but TP processing could still be applied (e.g., a dense applause signal corresponds to such a scenario).

Additionally, in certain implementations, in order to prevent possible artifacts in tonal signals, TP processing is not applied when the tonality of the transmitted sum signal(s) is high.

Furthermore, similar measures can be used in the BCC encoder to detect when TP processing should be active. Since the encoder has access to all original input signals, it may employ more sophisticated algorithms (e.g., a part of estimation block 208) to make a decision of when TP processing should be enabled. The result of this decision (a flag signaling when TP should be active) can be transmitted to the BCC decoder (e.g., as part of the side information of FIG. 2).

Although the present invention has been described in the context of BCC coding schemes in which there is a single sum signal, the present invention can also be implemented in the context of BCC coding schemes having two or more sum signals. In this case, the temporal envelope for each different "base" sum signal can be estimated before applying BCC synthesis, and different BCC output channels may be generated based on different temporal envelopes, depending on which sum signals were used to synthesize the different output channels. An output channel that is synthesized from two or more different sum channels could be generated based on an effective temporal envelope that takes into account (e.g., via weighted averaging) the relative effects of the constituent sum channels.

Although the present invention has been described in the context of BCC coding schemes involving ICTD, ICLD, and ICC codes, the present invention can also be implemented in the context of other BCC coding schemes involving only one or two of these three types of codes (e.g., ICLD and ICC, but not ICTD) and/or one or more additional types of codes. Moreover, the sequence of BCC synthesis processing and envelope shaping may vary in different implementations. For example, when envelope shaping is applied to frequency-domain signals, as in FIGS. 14 and 16, envelope shaping could alternatively be implemented after ICTD synthesis (in those embodiments that employ ICTD synthesis), but prior to ICLD synthesis. In other embodiments, envelope shaping could be applied to upmixed signals before any other BCC synthesis is applied.

Although the present invention has been described in the context of BCC coding schemes, the present invention can also be implemented in the context of other audio processing systems in which audio signals are de-correlated or other audio processing that needs to de-correlate signals.

Although the present invention has been described in the context of implementations in which the encoder receives input audio signal in the time domain and generates transmitted audio signals in the time domain and the decoder receives the transmitted audio signals in the time domain and generates playback audio signals in the time domain, the present invention is not so limited. For example, in other implementations, any one or more of the input, transmitted, and playback audio signals could be represented in a frequency domain.

BCC encoders and/or decoders may be used in conjunction with or incorporated into a variety of different applications or systems, including systems for television or electronic music distribution, movie theaters, broadcasting, streaming, and/or reception. These include systems for encoding/decoding transmissions via, for example, terrestrial, satellite, cable, internet, intranets, or physical media (e.g., compact discs, digital versatile discs, semiconductor chips, hard drives, memory cards, and the like). BCC encoders and/or decoders may also be employed in games and game systems, including, for example, interactive software products intended to interact with a user for entertainment (action, role play, strategy, adventure, simulations, racing, sports, arcade, card, and board games) and/or education that may be published for multiple machines, platforms, or media. Further, BCC encoders and/or decoders may be incorporated in audio recorders/players or CD-ROM/DVD systems. BCC encoders and/or decoders may also be incorporated into PC software applications that incorporate digital decoding (e.g., player, decoder) and software applications incorporating digital encoding capabilities (e.g., encoder, ripper, recoder, and jukebox).

The present invention may be implemented as circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing steps in a software program. Such software may be employed in, for example, a digital signal processor, microcontroller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

It will be further understood that various changes in the details, materials, and arrangements of the parts which have been described and illustrated in order to explain the nature of this invention may be made by those skilled in the art without departing from the scope of the invention as expressed in the following claims.

Although the steps in the following method claims, if any, are recited in a particular sequence with corresponding labeling, unless the claim recitations otherwise imply a particular sequence for implementing some or all of those steps, those steps are not necessarily intended to be limited to being implemented in that particular sequence.

We claim:

1. A decoding method for receiving and converting an encoded audio signal having a temporal envelope into an output audio signal having an output temporal envelope, the decoding method comprising:

receiving the encoded audio signal at a decoder;

determining, by the decoder, the temporal envelope of the encoded audio signal, wherein the decoder determines the temporal envelope of the encoded audio signal without relying on any parametric data received by the decoder with the encoded audio signal;

decoding, by the decoder, the encoded audio signal to generate a decoded audio signal, wherein the decoding de-correlates the encoded audio signal; and adjusting, by the decoder, the decoded audio signal based on the determined temporal envelope to generate the output audio signal, wherein the output temporal envelope substantially matches the temporal envelope of the encoded audio signal.

2. The invention of claim 1, wherein the decoding comprises inter-channel correlation (ICC) synthesis.

3. The invention of claim 2, wherein the ICC synthesis is part of binaural cue coding (BCC) synthesis.

4. The invention of claim 3, wherein the BCC synthesis further comprises at least one of inter-channel level difference (ICLD) synthesis and inter-channel time difference (ICTD) synthesis.

5. The invention of claim 2, wherein the ICC synthesis comprises late-reverberation ICC synthesis.

6. The invention of claim 1, wherein the adjusting comprises:

determining a decoded temporal envelope of the decoded audio signal; and adjusting the decoded audio signal based on both the determined and decoded temporal envelopes to generate the output audio signal.

7. The invention of claim 6, wherein the adjusting comprises:

generating a scaling function based on the determined and decoded temporal envelopes; and applying the scaling function to the decoded audio signal to generate the output audio signal.

8. The invention of claim 1, further comprising adjusting the encoded audio signal based on the determined temporal envelope to generate a flattened audio signal, wherein:

the decoding is applied to the flattened audio signal to generate the decoded audio signal; and the adjusting of the decoded audio signal based on the determined temporal envelope unflattens the decoded audio signal to generate the output audio signal as an unflattened audio signal.

9. The invention of claim 1, wherein:

the decoding generates an uncorrelated decoded signal and a correlated decoded signal; and the adjusting is applied to the uncorrelated decoded signal to generate an adjusted decoded signal, wherein the output signal is generated by summing the adjusted decoded signal and the correlated decoded signal.

10. The invention of claim 1, wherein:

the determining is applied only to specified frequencies of the encoded audio signal; and the adjusting is applied only to the specified frequencies of the decoded audio signal.

11. The invention of claim 10, wherein:

the determining is applied only to frequencies of the encoded audio signal above a specified cutoff frequency; and the adjusting is applied only to frequencies of the decoded audio signal above the specified cutoff frequency.

12. The invention of claim 1, wherein each of the determining, the decoding, and the adjusting is applied to a frequency-domain signal.

13. The invention of claim 12, wherein each of the determining, the decoding, and the adjusting is individually applied to different signal subbands.

14. The invention of claim 12, wherein the frequency domain corresponds to a fast Fourier transform (FFT).

15. The invention of claim 12, wherein the frequency domain corresponds to a quadrature mirror filter (QMF).

16. The invention of claim 1, wherein each of the determining and the adjusting is applied to a time-domain signal.

17. The invention of claim 16, wherein the decoding is applied to a frequency-domain signal.

18. The invention of claim 17, wherein the frequency domain corresponds to an FFT.

19. The invention of claim 17, wherein the frequency domain corresponds to a QMF.

20. The invention of claim 1, further comprising deciding whether to enable or disable the determining and the adjusting.

21. The invention of claim 20, wherein the deciding is based on an enable/disable flag generated by an audio encoder that generated the encoded audio signal.

22. The invention of claim 20, wherein the deciding is based on analyzing the encoded audio signal to detect transients in the encoded audio signal such that the determining and the adjusting are enabled if occurrence of a transient is detected.

23. The invention of claim 1, further comprising:

determining, by the decoder, the decoded temporal envelope of the decoded audio signal, wherein the decoder adjusts the decoded audio signal based on both the determined temporal envelope and the determined decoded temporal envelope to generate the output audio signal.

24. The invention of claim 23, wherein the decoder adjusts the decoded audio signal to generate the output audio signal by:

applying an inverse envelope adjustment to the decoded audio signal based on the determined decoded temporal envelope to generate a flattened decoded audio signal; and applying envelope adjustment to the flattened decoded audio signal based on the determined temporal envelope to generate the output audio signal.

25. The invention of claim 1, further comprising:

applying, by the decoder, an inverse envelope adjustment to the encoded audio signal based on the determined temporal envelope to generate a flattened audio signal, wherein the decoder decodes the flattened audio signal to generate the decoded audio signal.

26. The invention of claim 1, wherein:

the adjusting by the decoder of the decoded audio signal is applied to an uncorrelated late-reverberation signal generated by the decoding of the encoded audio signal to generate an envelope-adjusted late-reverberation signal; and further comprising combining the encoded audio signal and the envelope-adjusted late-reverberation signal to generate the output audio signal.

27. The invention of claim 1, wherein:

an encoder generated the encoded audio signal based on an original audio signal; and the encoded audio signal does not contain any parametric data representing temporal envelope of the original audio signal.

28. A decoder for receiving and converting an encoded audio signal having a temporal envelope into an output audio signal having an output temporal envelope, the decoder comprising:

means for receiving the encoded audio signal;

means for determining the temporal envelope of the encoded audio signal, wherein the means for determining determines the temporal envelope of the encoded audio signal without relying on any parametric data received by the decoder with the encoded audio signal;

means for decoding the encoded audio signal to generate a decoded audio signal, wherein the means for decoding is adapted to de-correlate the encoded audio signal; and means for adjusting the decoded audio signal based on the determined temporal envelope to generate the output audio signal, wherein the output temporal envelope substantially matches the temporal envelope of the encoded audio signal.

29. A decoder for receiving and converting an encoded audio signal having a temporal envelope into an output audio signal having an output temporal envelope, the decoder comprising:

an envelope extractor adapted to determine the temporal envelope of the encoded audio signal, wherein the envelope extractor determines the temporal envelope of the encoded audio signal without relying on any parametric data received by the decoder with the encoded audio signal;

a synthesizer adapted to decode the encoded audio signal to generate a decoded audio signal, wherein the synthesizer is adapted to de-correlate the encoded audio signal; and an envelope adjuster adapted to adjust the decoded audio signal based on the determined temporal envelope to generate the output audio signal, wherein the output temporal envelope substantially matches the temporal envelope of the encoded audio signal.

30. The invention of claim 29, wherein:

the apparatus is a system selected from the group consisting of a digital video player, a digital audio player, a computer, a satellite receiver, a cable receiver, a terrestrial broadcast receiver, a home entertainment system, and a movie theater system; and the system comprises the envelope extractor, the synthesizer, and the envelope adjuster.

31. A non-transitory machine-readable medium, having encoded thereon program code, wherein, when the program code is executed by a machine, the machine implements a decoding method for receiving and converting an encoded audio signal having an temporal envelope into an output audio signal having an output temporal envelope, the decoding method comprising:

receiving the encoded audio signal at a decoder;

determining, by the decoder, the temporal envelope of the encoded audio signal, wherein the decoder determines the temporal envelope of the encoded audio signal without relying on any parametric data received by the decoder with the encoded audio signal;

decoding, by the decoder, the encoded audio signal to generate a decoded audio signal, wherein the decoding de-correlates the encoded audio signal; and adjusting, by the decoder, the decoded audio signal based on the determined temporal envelope to generate the output audio signal, wherein the output temporal envelope substantially matches the temporal envelope of the encoded audio signal.

* * * * *